US009709951B2

(12) United States Patent
Sato

(10) Patent No.: US 9,709,951 B2
(45) Date of Patent: Jul. 18, 2017

(54) IMAGE FORMING APPARATUS AND MOVABLE DRAWER

(71) Applicant: Brother Kogyo Kabushiki Kaisha, Nagoya-shi, Aichi-ken (JP)

(72) Inventor: Shougo Sato, Setoshi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/015,788

(22) Filed: Feb. 4, 2016

(65) Prior Publication Data

US 2016/0231699 A1 Aug. 11, 2016

(30) Foreign Application Priority Data

Feb. 6, 2015 (JP) ..... 2015-022593

(51) Int. Cl.
*G03G 21/00* (2006.01)
*G03G 21/18* (2006.01)
*G03G 21/16* (2006.01)

(52) U.S. Cl.
CPC ..... *G03G 21/1842* (2013.01); *G03G 21/1623* (2013.01); *G03G 2221/1684* (2013.01); *G03G 2221/1869* (2013.01)

(58) Field of Classification Search
CPC ..... G03G 21/1623; G03G 21/1842; G03G 21/1853; G03G 2221/1684; G03G 2221/1869
USPC ..... 399/110, 111, 112
See application file for complete search history.

(56) References Cited

U.S. PATENT DOCUMENTS

| | | | |
|---|---|---|---|
| 6,587,660 | B2 | 7/2003 | Ueno et al. |
| 7,486,907 | B2 | 2/2009 | Noguchi et al. |
| 7,660,549 | B2 | 2/2010 | Noguchi et al. |
| 7,664,428 | B2 | 2/2010 | Kei |
| 7,684,728 | B2 | 3/2010 | Okabe et al. |
| 8,145,095 | B2 | 3/2012 | Sakurai et al. |
| 8,358,952 | B2 | 1/2013 | Okabe |
| 8,712,282 | B2 | 4/2014 | Sato |
| 8,729,805 | B2 | 5/2014 | Yagi et al. |

(Continued)

FOREIGN PATENT DOCUMENTS

| | | | |
|---|---|---|---|
| BR | 102012028057 | A2 | 6/2015 |
| CN | 101614996 | A | 12/2009 |

(Continued)

OTHER PUBLICATIONS

Feb. 5, 2016—Co-pending U.S. Appl. No. 15/016,581.

(Continued)

*Primary Examiner* — Robert Beatty
(74) *Attorney, Agent, or Firm* — Banner & Witcoff, Ltd.

(57) ABSTRACT

An image forming apparatus includes a casing, a process cartridge, a drawer configured to support the process cartridge and move between an inside position and an outside position. The drawer includes a bottom plate. The bottom plate is configured to support the process cartridge. The bottom plate has a flat surface on one side of the bottom plate and further has a recessed portion recessed relative to the flat surface toward the other side of the bottom plate. The drawer has the flat surface at a portion of the one side. The recessed portion has a support surface configured to support the process cartridge.

27 Claims, 15 Drawing Sheets

(56) References Cited

U.S. PATENT DOCUMENTS

| | | | | |
|---|---|---|---|---|
| 8,755,718 | B2 | 6/2014 | Ushiozu et al. | |
| 8,768,206 | B2 | 7/2014 | Sato | |
| 8,792,805 | B2 | 7/2014 | Takayama | |
| 8,855,530 | B2 | 10/2014 | Sato | |
| 8,862,022 | B2 | 10/2014 | Sato et al. | |
| 8,892,002 | B2 | 11/2014 | Sato | |
| 8,929,770 | B2 | 1/2015 | Sato | |
| 8,948,656 | B2 | 2/2015 | Nakano | |
| 9,037,036 | B2 | 5/2015 | Yamashita et al. | |
| 9,052,688 | B2 | 6/2015 | Sekido | |
| 9,134,686 | B2 | 9/2015 | Yoshikawa et al. | |
| 9,134,695 | B2 | 9/2015 | Furukawa et al. | |
| 9,146,492 | B2 | 9/2015 | Suzuki | |
| 2007/0077087 | A1 | 4/2007 | Okabe et al. | |
| 2007/0160385 | A1 | 7/2007 | Noguchi et al. | |
| 2009/0047039 | A1 | 2/2009 | Noguchi et al. | |
| 2009/0092412 | A1 | 4/2009 | Kei | |
| 2009/0116869 | A1 | 5/2009 | Kotsuka et al. | |
| 2009/0290903 | A1 | 11/2009 | Horikawa et al. | |
| 2009/0290904 | A1 | 11/2009 | Kawai et al. | |
| 2009/0290905 | A1 | 11/2009 | Mizuno et al. | |
| 2009/0324275 | A1 | 12/2009 | Okabe | |
| 2010/0080615 | A1 | 4/2010 | Kikuchi | |
| 2010/0080619 | A1 | 4/2010 | Kawanami | |
| 2010/0080623 | A1* | 4/2010 | Tanaka | G03G 21/08 399/118 |
| 2010/0111562 | A1 | 5/2010 | Okabe et al. | |
| 2010/0124432 | A1 | 5/2010 | Takayama | |
| 2010/0239314 | A1 | 9/2010 | Takayama | |
| 2011/0217074 | A1 | 9/2011 | Kawanami | |
| 2012/0057900 | A1 | 3/2012 | Okabe | |
| 2012/0114374 | A1 | 5/2012 | Suzuki | |
| 2012/0195627 | A1* | 8/2012 | Kikuchi | G03G 21/1647 399/110 |
| 2012/0328325 | A1 | 12/2012 | Sato | |
| 2012/0328326 | A1 | 12/2012 | Sato | |
| 2012/0328327 | A1 | 12/2012 | Sato | |
| 2012/0328372 | A1 | 12/2012 | Hawkes et al. | |
| 2013/0108316 | A1 | 5/2013 | Sato et al. | |
| 2013/0308976 | A1 | 11/2013 | Sekido | |
| 2013/0315619 | A1 | 11/2013 | Shuhama et al. | |
| 2014/0064782 | A1 | 3/2014 | Furukawa et al. | |
| 2014/0137372 | A1 | 5/2014 | Yamashita et al. | |
| 2014/0147158 | A1 | 5/2014 | Fujinaka et al. | |
| 2014/0186082 | A1 | 7/2014 | Yoshikawa et al. | |
| 2014/0210929 | A1 | 7/2014 | Suzuki | |
| 2014/0241749 | A1* | 8/2014 | Okabe | G03G 21/1864 399/90 |
| 2014/0294438 | A1* | 10/2014 | Okabe | G03G 21/1619 399/110 |
| 2014/0314446 | A1 | 10/2014 | Sato | |
| 2015/0010325 | A1 | 1/2015 | Sato et al. | |
| 2015/0023691 | A1 | 1/2015 | Sato | |
| 2015/0071681 | A1 | 3/2015 | Sato | |
| 2015/0110523 | A1 | 4/2015 | Sato | |
| 2015/0227110 | A1 | 8/2015 | Yoshimura et al. | |
| 2015/0261180 | A1 | 9/2015 | Sato | |
| 2016/0004214 | A1 | 1/2016 | Sato | |
| 2016/0026151 | A1 | 1/2016 | Sato et al. | |

FOREIGN PATENT DOCUMENTS

| | | | | |
|---|---|---|---|---|
| CN | 102483603 | A | | 5/2012 |
| CN | 103092022 | A | | 5/2013 |
| CN | 103425021 | A | | 12/2013 |
| CN | 103454871 | A | | 12/2013 |
| CN | 103853023 | A | | 6/2014 |
| CN | 104360589 | A | | 2/2015 |
| CN | 104583879 | A | | 4/2015 |
| CN | 105068394 | A | | 11/2015 |
| DE | 102013224071 | A1 | | 5/2014 |
| EP | 2138908 | A1 | | 12/2009 |
| EP | 2592496 | A2 | | 5/2013 |
| EP | 2667263 | A2 | | 11/2013 |
| EP | 2669746 | A2 | | 12/2013 |
| GB | 2510033 | A | | 7/2014 |
| GB | 2522520 | A | | 7/2015 |
| JP | 63008653 | A | * | 1/1988 |
| JP | H09-304994 | A | | 11/1997 |
| JP | H11-344905 | A | | 12/1999 |
| JP | 2001-337580 | A | | 12/2001 |
| JP | 2004-177443 | A | | 6/2004 |
| JP | 2007-101635 | A | | 4/2007 |
| JP | 2009-092914 | | | 4/2009 |
| JP | 2010-008724 | A | | 1/2010 |
| JP | 2010-102326 | A | | 5/2010 |
| JP | 2010-117731 | A | | 5/2010 |
| JP | 2010-217813 | A | | 9/2010 |
| JP | 2011-059730 | A | | 3/2011 |
| JP | 2011-070142 | A | | 4/2011 |
| JP | 2012-073656 | A | | 4/2012 |
| JP | 2013-007946 | A | | 1/2013 |
| JP | 2013-007947 | A | | 1/2013 |
| JP | 2013-007948 | A | | 1/2013 |
| JP | 2013-097185 | A | | 5/2013 |
| JP | 2013-242439 | A | | 12/2013 |
| JP | 2013-246366 | A | | 12/2013 |
| JP | 2014-067005 | A | | 4/2014 |
| JP | 2014-067010 | A | | 4/2014 |
| JP | 2014-106392 | A | | 6/2014 |
| JP | 2014-106393 | A | | 6/2014 |
| JP | 2014-123107 | A | | 7/2014 |
| JP | 2014-126842 | A | | 7/2014 |
| KR | 20120056849 | A | | 6/2012 |
| KR | 20130048156 | A | | 5/2013 |
| KR | 20130129847 | A | | 11/2013 |
| RU | 2012146552 | A | | 5/2014 |
| RU | 2013123016 | A | | 11/2014 |
| RU | 2014125088 | A | | 12/2015 |
| TW | 201411301 | A | | 3/2014 |
| WO | 2011024491 | A1 | | 3/2011 |
| WO | 2014038725 | A1 | | 3/2014 |

OTHER PUBLICATIONS

Feb. 5, 2016—Co-pending U.S. Appl. No. 15/016,616.
Feb. 5, 2016—Co-pending U.S. Appl. No. 15/016,646.
Feb. 4, 2016—Co-pending U.S. Appl. No. 15/015,323.
Feb. 3, 2016—Co-pending U.S. Appl. No. 15/014,137.
Feb. 5, 2016—Co-pending U.S. Appl. No. 15/016,638.
May 19, 2016—Non-Final Office Action—U.S. Appl. No. 15/014,137.
Jun. 3, 2016—Ex-parte Quayle Action—U.S. Appl. No. 15/016,638.
Jun. 6, 2016—Notice of Allowance—U.S. Appl. No. 15/016,581.
Jun. 17, 2016—Non-Final Office Action—U.S. Appl. No. 15/016,616.
Aug. 12, 2016—Notice of Allowance—U.S. Appl. No. 15/014,137.
Aug. 22, 2016—Non-Final Office Action—U.S. Appl. No. 15/016,646.
Oct. 11, 2016—Notice of Allowance—U.S. Appl. No. 15/016,616.
Oct. 13, 2016—Notice of Allowance—U.S. Appl. No. 15/016,638.
Oct. 21, 2016—Non-Final Office Action—U.S. Appl. No. 15/016,581.

* cited by examiner

IMAGE FORMING APPARATUS AND MOVABLE DRAWER

CROSS-REFERENCE TO RELATED APPLICATION

This application claims priority from Japanese Patent Application No. 2015-022593, filed on Feb. 6, 2015, which is incorporated herein by reference in their entirety.

TECHNICAL FIELD

Aspects described herein relate to an electrophotographic image forming apparatus and a movable member attached to the image forming apparatus.

BACKGROUND

A known electrophotographic tandem-type image forming apparatus includes a plurality of process cartridges each including a photosensitive drum for one of colors (e.g., yellow, magenta, cyan, and black).

The known image forming apparatus further includes a drawer frame having a generally box shape. The drawer frame is configured to accommodate the plurality of process cartridges therein. The drawer frame is movable between a position inside a main body of the image forming apparatus and a position outside the main body of the image forming apparatus for having one or more of the plurality of process cartridges attached thereto or detached therefrom.

SUMMARY

Nevertheless, in the image forming apparatus, the drawer frame has a generally box shape. Therefore, a configuration for transmitting a driving force to the photosensitive drums of the process cartridges accommodated in the drawer frame may be complicated. Further, the drawer frame may be configured to accommodate the plurality of process cartridges therein, whereby the drawer frame may have a relatively large size.

Accordingly, some embodiments of the disclosure provide for an image forming apparatus having a reduced size and a movable member having a reduced size and a simple configuration.

DESCRIPTION OF THE DRAWINGS

Aspects of the disclosure are illustrated by way of example and not by limitation in the accompanying figures in which like reference characters indicate similar elements.

DETAILED DESCRIPTION

For a more complete understanding of the present disclosure, needs satisfied thereby, and the objects, features, and advantages thereof, reference now is made to the following descriptions taken in connection with the accompanying drawings. Hereinafter, illustrative embodiments of the disclosure will be described in detail with reference to the accompanying drawings.

1. Overall Configuration of Printer

Figure 1:
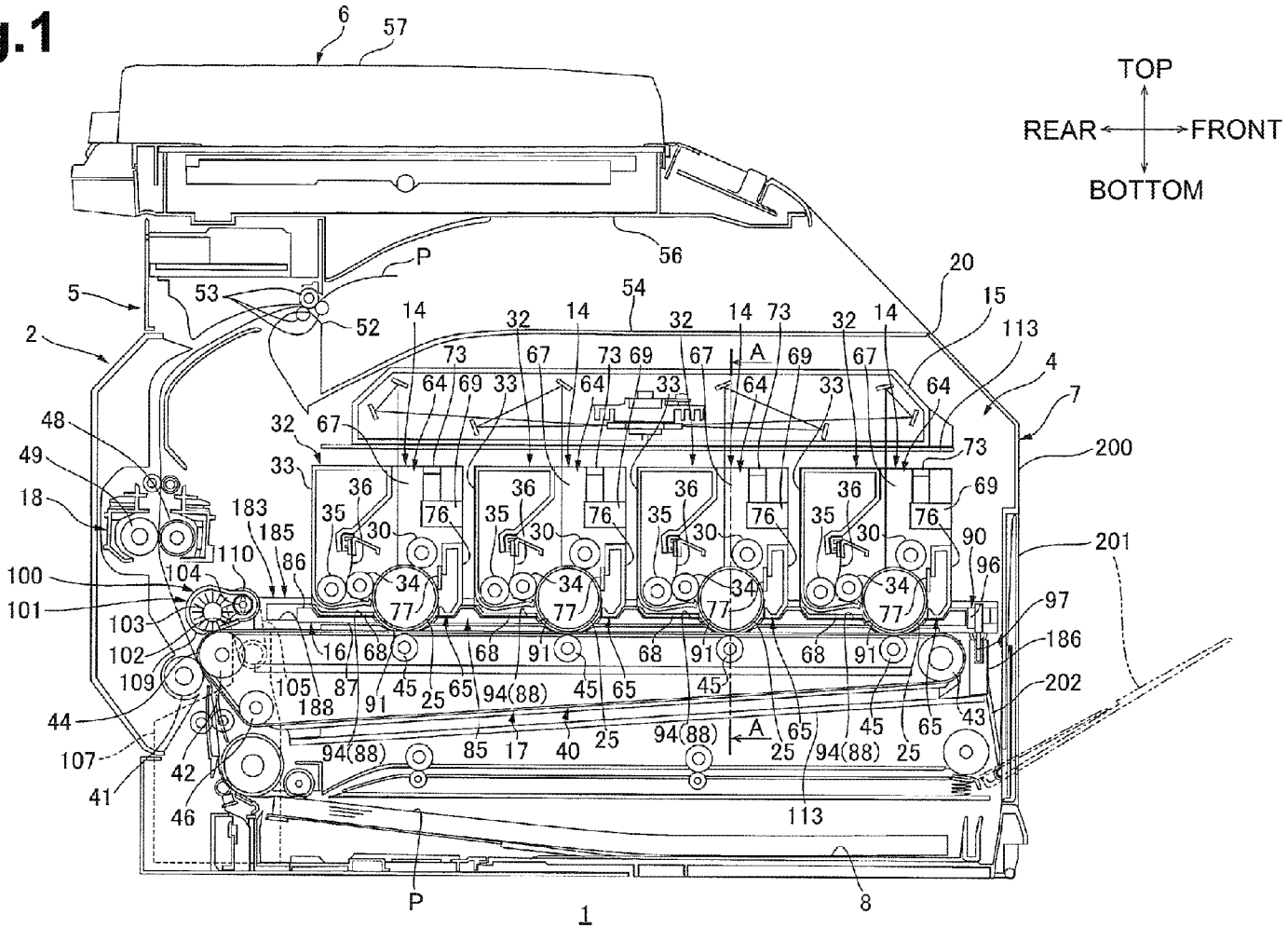
FIG. 1 is a central sectional view depicting a printer as an image forming apparatus in a first illustrative embodiment according to one or more aspects of the disclosure, wherein a drawer is located at an adjacent position of an inside position.

As depicted in FIG. 1, a printer 1 (as an example of an image forming apparatus) may be an intermediate transfer type color printer in which process cartridges 14 are arranged side by side in a horizontal direction.

With reference to the printer 1, directions of up, down, right, left, front, and rear may be defined with reference to an orientation of the printer 1 that is disposed in which it is intended to be used as depicted in FIG. 1.

The printer 1 includes a casing 2, an image forming unit 4, a discharge unit 5, and an image reading unit 6. The image forming unit 4 forms an image onto a sheet P. The discharge unit 5 discharges a sheet P having an image formed thereon. The image reading unit 6 reads image information from a document.

The casing 2 has a generally box shape and has an opening 20. The casing 2 includes a front cover 7 and a sheet feed tray 8.

The opening 20 is defined in a front end portion of the casing 2. The opening 20 provides communication between the inside and the outside of the casing 2 in a front-rear direction (as an example of a sliding direction) of the printer 1.

The front cover 7 is swingable between a closing position (e.g., a position of the front cover 7 depicted in FIG. 1) and an exposing position (e.g., a position of the front cover 7 depicted in FIGS. 9 and 11) on its lower end portion of a front wall of the casing 2. When the front cover 7 is located at the closing position (refer to FIG. 1), the front cover 7 closes the opening 20. When the front cover 7 is located at the exposing position (refer to FIGS. 9 and 11), the front cover 7 exposes the opening 20.

As depicted in FIG. 1, the sheet feed tray 8 is disposed in a lower end portion of the casing 2. The sheet feed tray 8 is detachably attachable to the casing 2. The sheet feed tray 8 is configured to support one or more sheets P thereon. The one or more sheets P supported by the sheet feed tray 8 are conveyed one by one to between an intermediate transfer belt 44 and a secondary transfer roller 41 by rotation of rollers at a predetermined timing.

An upper surface of the casing 2 is defined as a sheet discharge tray 54.

The image forming unit 4 includes an exposing device 15, a drawer 16, a plurality of, for example, four, process cartridges 14, a transfer unit 17, and a fixing unit 18.

The exposing device 15 is disposed in an upper end portion of the casing 2. As indicated by solid lines in FIG. 1, the exposing device 15 emits laser beams toward a plurality of, for example, four, photosensitive drums 25, respectively, based on image data to expose surfaces of the photosensitive drums 25.

The drawer 16 is disposed below the exposing device 15 in a substantially middle portion of the casing 2 in an up-down direction.

The process cartridges 14 each include the photosensitive drum 25, a charging roller 30, and a developing unit 32. The charging roller 30 charges the surface of the photosensitive drum 25. The developing unit 32 develops an electrostatic latent image, which is formed on the surface of the photosensitive drum 25 by the exposing device 15, to a toner image. The process cartridges 14 are supported by the drawer 16.

The transfer unit 17 is disposed below the drawer 16 and above the sheet feed tray 8 in a lower portion of the casing 2. The transfer unit 17 includes a belt unit 40 and the secondary transfer roller 41.

The belt unit 40 extends along the front-rear direction such that the belt unit 40 is disposed below all of the photosensitive drums 25. The belt unit 40 includes a drive roller 42, a driven roller 43, a tension roller 46, the intermediate transfer belt 44 (as an example of a transfer medium), and a plurality of, for example, four, primary transfer rollers 45. The primary transfer rollers 45 perform primary transfer for transferring toner images formed on the surfaces of the photosensitive drums 25, respectively, onto the intermediate transfer belt 44.

The drive roller 42 is rotatably disposed at a rear end portion of the belt unit 40.

The driven roller 43 is rotatably disposed at a front end portion of the belt unit 40.

The tension roller 46 is disposed lower and further to the front than the drive roller 42 while being rotatably disposed a lower rear portion of the belt unit 40.

The intermediate transfer belt 44 is wound around the drive roller 42, the driven roller 43, and the tension roller 46 such that an outer surface of an upper portion of the intermediate transfer belt 44 is in contact with lower end portions of all of the photosensitive drums 25. The intermediate transfer belt 44 rotates by rotation of the drive roller 42 and by rotation of the driven roller 43 caused following the rotation of the drive roller 42 such that the upper portion of the intermediate transfer belt 44 moves frontward. The tension roller 46 presses a lower portion of the intermediate transfer belt 44 downward to provide a tension on the intermediate transfer belt 44.

The primary transfer rollers 45 are arranged side by side between the drive roller 42 and the driven roller 43 in the front-rear direction while being spaced apart from each other in the front-rear direction. The primary transfer rollers 45 are disposed below the respective photosensitive drums 25 such that the primary transfer rollers 45 are across the intermediate transfer belt 44 from the respective photosensitive drums 25. The primary transfer rollers 45 are in contact with an inner surface of the upper portion of the intermediate transfer belt 44 from below.

The secondary transfer roller 41 is disposed lower and further to the rear than the drive roller 42 in the belt unit 40 while being across the intermediate transfer belt 44 from the drive roller 42. The secondary transfer roller 41 performs secondary transfer for transferring a color image formed on the surface of the intermediate transfer belt 44 onto a sheet P fed from the sheet feed tray 8.

The fixing unit 18 is disposed higher and further to the rear than the secondary transfer roller 41. The fixing unit 18 includes a heat roller 48 and a pressing roller 49. The pressing roller 49 presses a rear end portion of the heat roller 48. The fixing unit 18 is configured to fix a color image transferred onto a sheet P thereon by heat while the sheet P having the color image passes between the heat roller 48 and the pressing roller 49.

The discharge unit 5 protrudes upward from an upper rear end portion of the casing 2. The discharge unit 5 includes an outlet 52 and a plurality of, for example, three, discharge rollers 53. The outlet 52 allows a sheet P that has passed the fixing unit 18 to pass therethrough for discharging the sheet P onto the sheet discharge tray 54.

The outlet 52 provides communication between the inside and the outside of the casing 2 at a front surface of the discharge unit 5.

The discharge rollers 53 are disposed so as to pinch and guide a sheet P to be discharged through the outlet 52.

The image reading unit 6 is disposed above the casing 2 so as to cover the sheet discharge tray 54. The image reading unit 6 has a generally rectangular shape in plan view and has substantially the same dimensions in the front-rear direction and in a right-left direction as the casing 2. The image reading unit 6 includes a document rest 56 and a retaining cover 57. The document rest 56 is configured to support a document thereon. The retaining cover 57 is swingably supported by the document rest 56.

The image forming unit 4 forms an image onto a sheet P based on image information read from a document by the image reading unit 6.

2. Details of Process Cartridges

All of the process cartridges 14 have the same or similar configuration except color of toner stored therein, and therefore, one of the process cartridges 14 will be described in detail.

Figure 2:
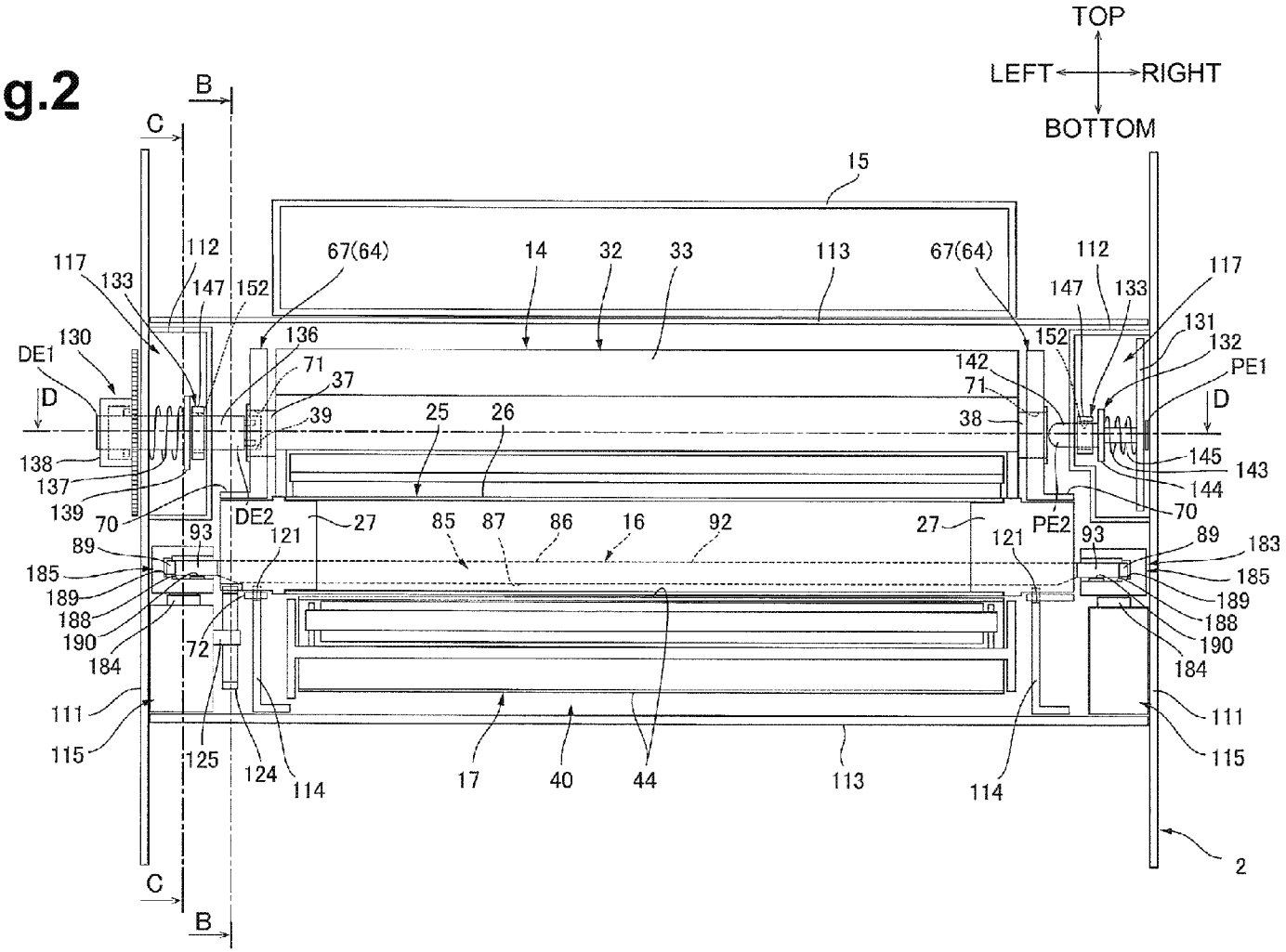
FIG. 2 is a sectional view taken along line A-A of the printer of FIG. 1 in the first illustrative embodiment according to one or more aspects of the disclosure.

As depicted in FIGS. 1 and 2, a process cartridge 14 includes a cartridge frame 64, a photosensitive drum 25, a charging roller 30, a developing unit 32, and a drum cleaning unit 65.

Figure 10:
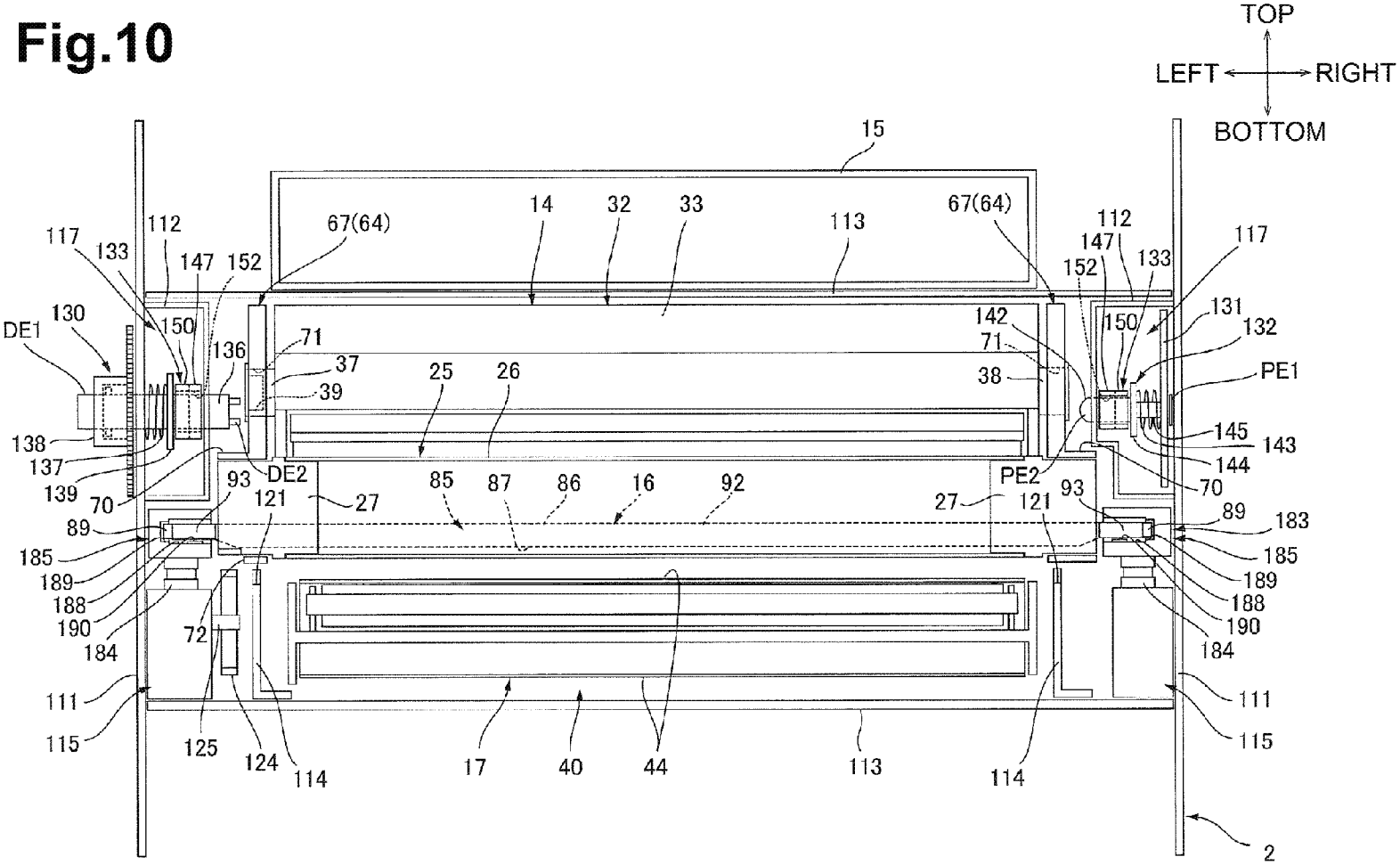
FIG. 10 is a sectional view depicting the printer of FIG. 2 in the first illustrative embodiment according to one or more aspects of the disclosure, wherein the drawer is located at the distant position of the inside position.

The process cartridge 14 is configured to move in the up-down direction (as an example of an orthogonal direction) between a first position (e.g., a position of the process cartridge 14 depicted in FIGS. 1 and 2) and a second position (e.g., a position of the process cartridge 14 depicted in FIG. 10). When the process cartridge 14 is located at the first position (refer to FIGS. 1 and 2), a lower end portion of the photosensitive drum 25 is in contact with the outer surface of the upper portion of the intermediate transfer belt 44. When the process cartridge 14 is located at the second position (refer to FIG. 10), the photosensitive drum 25 is distanced from the outer surface of the upper portion of the intermediate transfer belt 44.

(1) Cartridge Frame

Figure 3:
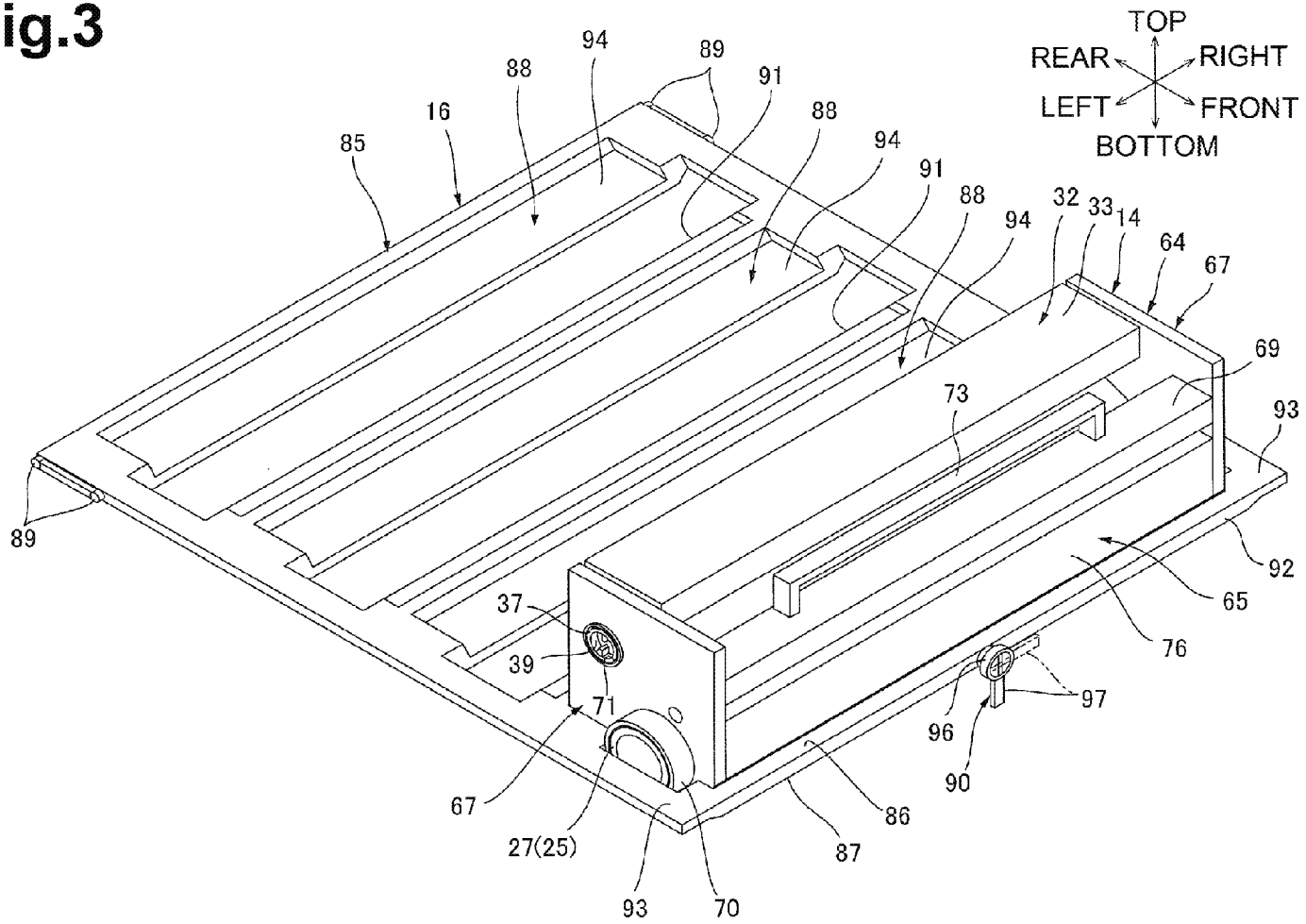
FIG. 3 is an upper front perspective view depicting a drawer of FIG. 1 in the first illustrative embodiment according to one or more aspects of the disclosure, wherein a frontmost support surface supports a process cartridge.

As depicted in FIGS. 1 and 3, the cartridge frame 64 includes right and left side walls 67, a bottom wall 68, and a connecting bar 69.

The right and left side walls 67 are spaced apart from each other in the right-left direction (as an example of an axial direction). The side walls 67 have a generally rectangular plate shape in side view and extend both in the up-down direction and in the front-rear direction. The left side wall 67 is an example of a first end portion of the process cartridge 14, and the right side wall 67 is an example of a second end portion of the process cartridge. Both of the right and left side walls 67 have the same or similar configuration, and therefore, one of the right and left side walls 67 will be described in detail. As depicted in FIGS. 2 and 3, a side wall 67 has a flange support portion 70 and a through hole 71.

The flange support portion 70 has a generally hollow cylindrical shape and protrudes toward the exterior of the printer 1 in the right-left direction from a lower front end of the side wall 67. The flange support portion 70 penetrates the side wall 67. The flange support portion 70 of the left side wall 67 has a cutout 72.

The cutout 72 is recessed rightward relative to a lower left end portion of the flange support portion 70 of the left side wall 67 for exposing a lower end portion of a flange 27.

The through hole 71 is defined in an upper rear end portion of the side wall 67 and is disposed higher and further to the rear than the flange support portion 70. The through hole 71 has a generally circular shape in side view and penetrates the side wall 67.

As depicted in FIG. 1, the bottom wall 68 extends between lower end portions of rear half portions of the side walls 67. The bottom wall 68 has a generally rectangular plate shape in bottom view and extends both in the front-rear direction and in the right-left direction.

As depicted in FIGS. 1 and 3, the connecting bar 69 extends between front end portions of the side walls 67. The connecting bar 69 is disposed at a position which is approximately ⅓ of a dimension in the up-down direction of the side wall 67 from an upper end of the side wall 67. The connecting bar 69 has a generally rectangular bar shape in sectional view and extends in the right-left direction. The connecting bar 69 includes a handle 73 for a user to hold at the time of attaching or detaching the process cartridge 14 to or from the drawer 16.

The handle 73 is disposed at a substantially middle portion of an upper surface of the connecting bar 69 in the right-left direction. The handle 73 has a generally inverted U-shaped plate in front view.

(2) Photosensitive Drum

As depicted in FIGS. 1 and 2, the photosensitive drum 25 is disposed at a lower end portion of the process cartridge 14 and at a substantially middle portion in the front-rear direction of the process cartridge 14. As depicted in FIG. 2, the photosensitive drum 25 includes a drum 26 and right and left flanges 27.

The drum 26 has a generally hollow cylindrical shape extending in the right-left direction. The drum 26 has a photosensitive layer on its surface.

One (e.g., the left flange 27) of the flanges 27 is disposed at a left end portion of the drum 26, and the other (e.g., the right flange 27) of the flanges 27 is disposed at a right end portion of the drum 26. The flanges 27 have a generally cylindrical column shape extending in the right-left direction. The flanges 27 have an outside diameter that is slightly smaller than an outside diameter of the drum 26. The left flange 27 has gear teeth on its circumferential surface of a left end portion thereof.

The photosensitive drum 25 is rotatably supported by the right and left side walls 67 while the left flange 27 is supported by the flange support portion 70 of the left side wall 67 and the right flange 27 is supported by the flange support portion 70 of the right side wall 67. A left end surface of the left flange 27 is flush with a left end surface of the left side wall 67 of the flange support portion 70 in the right-left direction. A right end surface of the right flange 27 is flush with a right end surface of the right side wall 67 of the flange support portion 70 in the right-left direction. A portion of a lower end portion of the left flange 27 is exposed through the cutout 72 of the flange support portion 70.

(3) Charging Roller

As depicted in FIG. 1, the charging roller 30 has a generally cylindrical column shape extending in the right-left direction. The charging roller 30 is disposed diagonally above the photosensitive drum 25. The center of the charging roller 30 is disposed further to the front than the center of the photosensitive drum 25. A lower rear end portion of the charging roller 30 is in contact with an upper front end portion of the photosensitive drum 25. The charging roller 30 is rotatably supported by the side walls 67 while a left end portion of the charging roller 30 is supported by the left side wall 67 and a right end portion of the charging roller 30 is supported by the right side wall 67.

(4) Developing Unit

Figure 6:
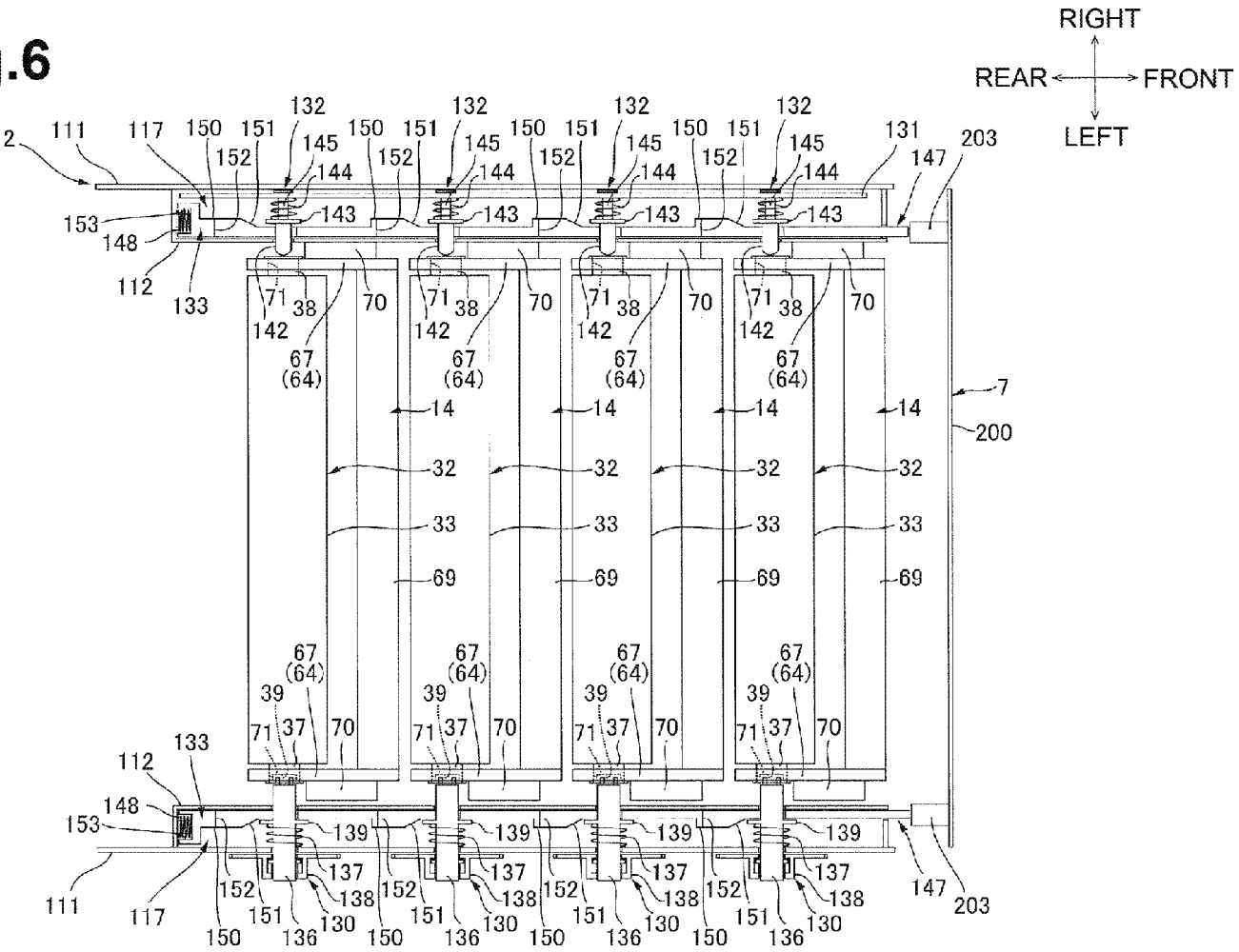
FIG. 6 is a sectional view taken along line D-D of the printer of FIG. 2 in the first illustrative embodiment according to one or more aspects of the disclosure, wherein developing units are illustrated in plan view for convenience in drawing.

As depicted in FIGS. 1 and 6, the developing unit 32 is disposed higher and further to the rear than the photosensitive drum 25. The developing unit 32 is configured to store toner therein. The developing unit 32 includes a developing frame 33, a developing roller 34, a supply roller 35, a layer-thickness regulating blade 36, a driving-force receiving member 37, and an electrode member 38. The driving-force receiving member 37 is configured to receive a driving force from the casing 2. The electrode member 38 is configured to receive electric power from the casing 2.

As depicted in FIG. 1, the developing frame 33 is disposed higher and further to the rear than the photosensitive drum 25 in a rear end portion of the process cartridge 14. The developing frame 33 has a generally rectangular hollow cylindrical shape. The developing frame 33 extends in the right-left direction and has closed ends in the right-left direction. The developing frame 33 has an opening at a lower front end portion thereof. The opening extends in the right-left direction across a lower front end portion of the developing frame 33 so as to provide communication between the outside and the inside of the developing frame 33.

The developing roller 34 is configured to supply toner onto a surface of the photosensitive drum 25. The developing roller 34 has a generally cylindrical column shape extending in the right-left direction. The developing roller 34 is disposed in a lower front end portion of the developing frame 33. A front end portion of the developing roller 34 is in contact with a rear end portion of the photosensitive drum 25.

The supply roller 35 is configured to supply toner onto a surface of the developing roller 34 from the developing unit 32. The supply roller 35 has a generally cylindrical column shape extending in the right-left direction and is disposed behind the developing roller 34. A front end portion of the supply roller 35 is press contact with a rear end portion of the developing roller 34.

The layer-thickness regulating blade 36 is configured to regulate a thickness of toner supplied onto the surface of the developing roller 34. The layer-thickness regulating blade 36 is disposed higher and further to the rear than the developing roller 34. The layer-thickness regulating blade 36 has a thickness in the front-rear direction and has a generally plate shape extending in the right-left direction. A lower end portion of the layer-thickness regulating blade 36 is in contact with an upper rear end portion of the developing roller 34.

As depicted in FIGS. 3 and 6, the driving-force receiving member 37 is configured to transmit, to the developing roller 34 and the supply roller 35, a driving force inputted thereto from a corresponding driving-force input member 130. The driving-force receiving member 37 is disposed at an upper end portion of a left wall of the developing frame 33. The driving-force receiving member 37 has a generally cylindrical column shape, and protrudes leftward relative to the left wall of the developing frame 33. The driving-force receiving member 37 is disposed in the through hole 71 of the left side wall 67 while passing therethrough. That is, the driving-force receiving member 37 is supported by the left side wall 67. Thus, the driving-force receiving member 37 is exposed through the through hole 71 when viewed from the left. The driving-force receiving member 37 has a hole 39 therein.

The hole 39 is recessed rightward relative to a left end of the driving-force receiving member 37 at a substantially middle portion of the driving-force receiving member 37 in left side view. The driving-force receiving member 37 has a generally circular shape in side view.

As depicted in FIGS. 2 and 6, the electrode member 38 is configured to supply the developing roller 34 and the supply roller 35 with electric power received from a corresponding electric-power supply member 132. The electrode member 38 is disposed at an upper end portion of a right wall of the developing frame 33. The electrode member 38 has a generally cylindrical column shape. The electrode member 38 protrudes rightward relative to the right wall of the developing frame 33. The electrode member 38 is disposed in the through hole 71 of the right side wall 67 while passing therethrough. That is, the electrode member 38 is supported by the right side wall 67. Thus, the electrode member 38 is exposed through the through hole 71 when viewed from the right.

(5) Drum Cleaning Unit

As depicted in FIGS. 1 and 3, the drum cleaning unit 65 is disposed in front of the photosensitive drum 25 in a lower front end portion of the process cartridge 14. The drum cleaning unit 65 is configured to collect residual toner from the surface of the photosensitive drum 25. The drum cleaning unit 65 includes a cleaning frame 76 and a cleaning blade 77.

The cleaning frame 76 is disposed in front of the photosensitive drum 25 in the lower end portion of the process cartridge 14. The cleaning frame 76 has a generally rectangular cylindrical shape extending in the right-left direction. A left end of the cleaning frame 76 is contiguous to an inner surface of the left side wall 67 in the right-left direction, and a right end of the cleaning frame 76 is contiguous to an inner surface of the right side wall 67 in the right-left direction. The cleaning frame 76 has an opening in a lower end portion of a rear wall so as to face a front end portion of the photosensitive drum 25. The opening extends across the lower end portion of the rear wall of the cleaning frame 76 in the right-left direction and penetrates the cleaning frame 76 in the front-rear direction.

As depicted in FIG. 1, the cleaning blade 77 is disposed at a rear surface of the cleaning frame 76. The cleaning blade 77 has a thickness in the front-rear direction and has a generally plate shape in the right-left direction. An upper end portion of the cleaning blade 77 is fixed to a lower end portion of the rear wall of the cleaning frame 76. In other words, the upper end portion of the cleaning blade 77 is fixed to an upper circumferential edge portion of the opening that penetrates the rear wall of the cleaning frame 76 in the front-rear direction. A lower end portion of the cleaning blade 77 protrudes relative to a lower end of the rear wall of the cleaning blade 77 and extends to an approximately upper half of the opening of the cleaning frame 76. A portion of the lower end portion of the cleaning blade 77 is in contact with a front end portion of the drum 26 of the photosensitive drum 25.

3. Details of Drawer

The drawer 16 is configured to support all of the process cartridges 14. The drawer 16 is configured to move in the front-rear direction between an inside position (e.g., a position of the drawer 16 depicted in FIGS. 1 and 4) and an outside position (e.g., a position of the drawer 16 depicted in FIG. 11). When the drawer 16 is located at the inside position (refer to FIGS. 1 and 4), the drawer 16 is located inside the casing 2. When the drawer 16 is located at the outside position (refer to FIG. 11), the drawer 16 is located outside the casing 2. The drawer 16 is further configured to move between an adjacent position (e.g., a position of the drawer 16 depicted in FIG. 1) and a distant position (e.g., a position of the drawer 16 depicted in FIG. 9) relative to the intermediate transfer belt 44 when the drawer 16 is located at the inside position. When the drawer 16 is located at the adjacent position (refer to FIG. 1), the drawer 16 is located adjacent to the intermediate transfer belt 44. When the drawer 16 is located at the distant position (refer to FIG. 9), the drawer 16 is located at a position farther from the intermediate transfer belt 44 than the drawer 16 that is located at the adjacent position.

As depicted in FIG. 3, the drawer 16 includes a plate 85 (referred to herein as a bottom plate 85 that supports bottom wall 68 of cartridge frame 64), a plurality of, for example, four, rollers 89, and a stopper 90.

As depicted in FIGS. 1 and 3, the bottom plate 85 has a generally rectangular plate shape in plan view and extends both in the front-rear direction and in the right-left direction. The bottom plate 85 has an upper surface 86 and a lower surface 87, and the upper surface 86 and the lower surface 87 are adjacent to each other in the up-down direction. The upper surface 86 of the bottom plate 85 is an example of a flat surface. The bottom plate 85 has no side plate that extends from its peripheral edges in the up-down direction.

As depicted in FIGS. 2 and 3, the bottom plate 85 includes a right end portion and a left end portion in the right-left direction. The bottom plate also includes a middle portion located between the right end portion and the left end portion. The lower surfaces of the right end portion and left end portion are higher than the lower surface of the middle portion across all cross-sectional views of the bottom plate 85 (except in the cross-sectional views across openings 91 as described herein). In other words, the right and left end portions of the bottom plate 85 have a thickness in the up-down direction that is thinner than the middle portion of the bottom plate 85. The middle portion of the bottom plate 85 may be a thick plate portion 92 and the right and left end portions of the bottom plate 85 may be thin plate portions 93. The left thin-plate portion 93 is an example of a first end portion of the bottom plate 85. The right thin-plate portion 93 is an example of a second end portion of the bottom plate 85.

The bottom plate 85 has a plurality of, for example, four, recessed portions 88 and a plurality of, for example, four, openings 91.

The recessed portions 88 are spaced apart from each other in the front-rear direction. The recessed portions 88 are recessed downward relative to the upper surface 86 of the bottom plate 85. The recessed portions 88 have a generally rectangular shape in plan view extending across the thick plate portion 92 in the right-left direction.

Each of the openings 91 is defined in a corresponding one of the recessed portions 88 and penetrates the bottom plate 85 in the up-down direction while being slightly spaced rearward from a front end of a corresponding one of the recessed portions 88. The openings 91 have a length that is longer than the recessed portions 88 such that right and left edges of the openings 91 are located closer to the exterior of the printer 1 than right and left edges of the recessed portions 88, respectively, in the right-left direction. The openings 91 have a generally rectangular shape in plan view and are elongated to the right and left thin plate portions 93.

The recessed portions 88 each have an up-facing surface that may be a support surface 94 for supporting a corresponding process cartridge 14.

Two of the rollers 89 are disposed side by side in the front-rear direction at a rear end portion of a left end of the drawer 16, and the other two of the rollers 89 are disposed side by side in the front-rear direction at a rear end portion of a right end of the drawer 16. The rollers 89 are configured to rotate on respective axes extending in the right-left direction.

The stopper 90 is disposed at a front end of the drawer 16. The stopper 90 includes a shaft portion 96 and a projecting portion 97.

The shaft portion 96 has a generally cylindrical column shape and protrudes rearward from a substantially middle portion in the right-left direction of a front end portion of the bottom plate 85. The shaft portion 96 is configured to rotate relative to the bottom plate 85.

The projecting portion 97 has a generally rectangular column shape. The projecting portion 97 extends from a portion of a periphery of the shaft portion 96 in a diameter direction of the shaft portion 96 toward the exterior of the printer 1.

With this configuration, the stopper 90 is configured to rotate on the shaft portion 96 between a restricting position and a non-restricting position. When the stopper 90 is located at the restricting position (e.g., a position of the stopper 90 indicated by a solid line in FIG. 3), the projecting portion 97 extends downward such that the projecting portion 97 is located below the lower surface 87 of the bottom plate 85 to restrict a movement of the drawer 16 in the front-rear direction. When the stopper 90 is located at the non-restricting position (e.g., a position of the stopper 90 indicated by a double-dotted and dashed line in FIG. 3), the projecting portion 97 extends rightward and is located between the upper surface 86 and the lower surface 87 of the bottom plate 85 in the up-down direction to permit the drawer 16 to move in the front-rear direction.

Figure 4:
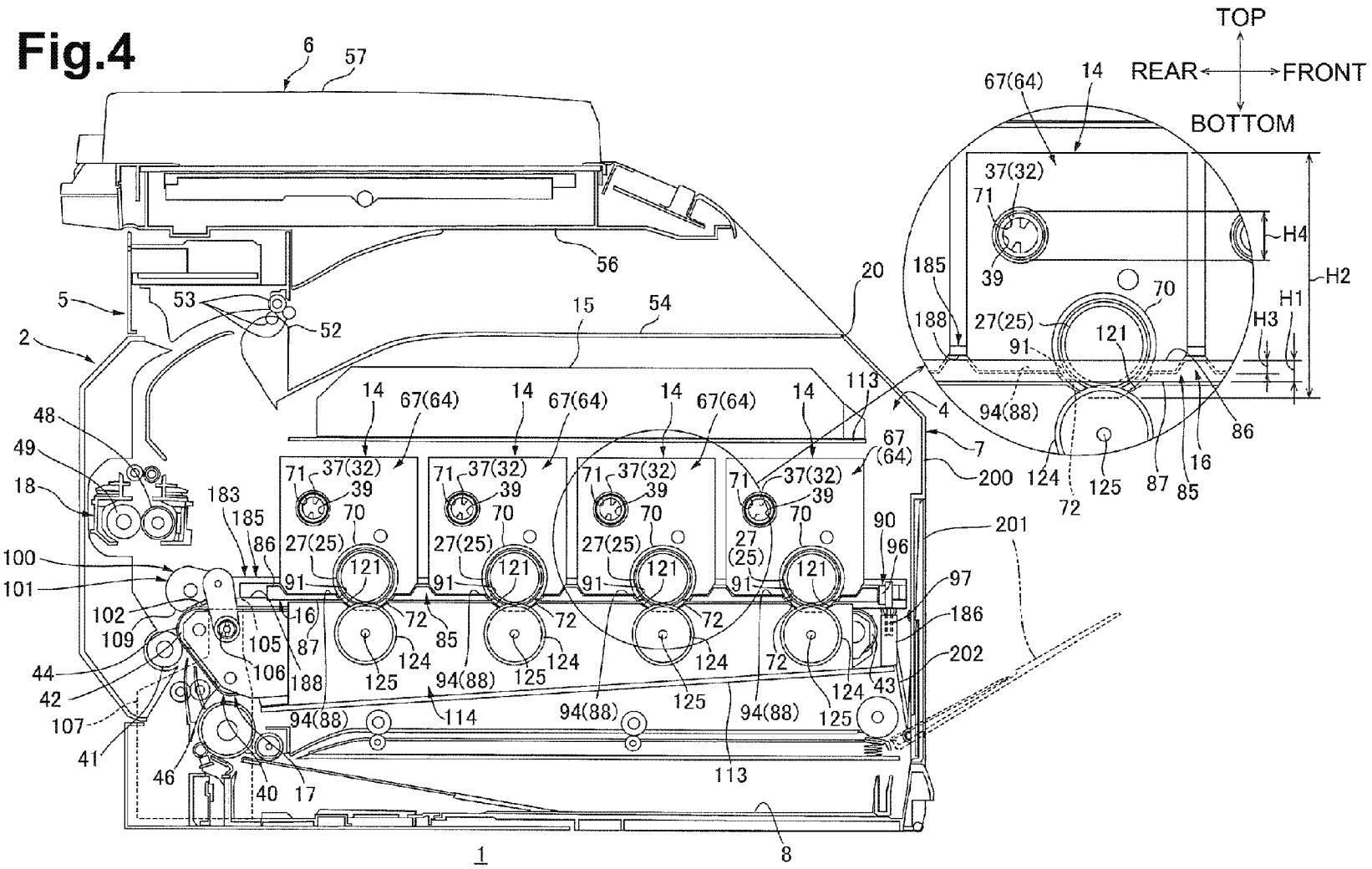
FIG. 4 is a sectional view taken along line B-B of the printer of FIG. 2 in the first illustrative embodiment according to one or more aspects of the disclosure.

As depicted in FIG. 4, a dimension in the up-down direction H1 of the bottom plate 85 is smaller than a dimension in the up-down direction H2 of the process cartridge 14. More specifically, the dimension in the up-down direction H1 of the bottom plate 85 may be between 3% and 30% inclusive, preferably between 5% and 10% inclusive, of the dimension in the up-down direction H2 of the process cartridge 14.

A dimension in the up-down direction H3 of the recessed portion 88 is smaller than the dimension in the up-down direction H2 of the process cartridge 14. More specifically, the dimension in the up-down direction H3 of the recessed portion 88 may be 10% or less, preferably between 2% and 8% inclusive, of the dimension in the up-down direction H2 of the process cartridge 14. All of the recessed portions 88 have the same dimension in the up-down direction.

A dimension in the up-down direction H1 of the bottom plate 85 is smaller than a dimension in the up-down direction H4 of the driving-force receiving member 37. More specifically, the dimension in the up-down direction H1 of the bottom plate 85 may be between 30% and 90% inclusive, preferably between 50% and 70% inclusive, of the dimension in the up-down direction H4 of the driving-force receiving member 37.

4. Details of Casing (1) Configuration of Belt Cleaning Unit of Casing

As depicted in FIGS. 1 and 4, the casing 2 includes a belt cleaning unit 100.

The belt cleaning unit 100 includes a cleaning frame 101, a cleaning blade 102, a brush roller 103, a screw 104, a connecting tube 105, a screw 106, and a residual toner box 107.

The cleaning frame 101 is disposed above the drive roller 42 while the cleaning frame 101 and the drive roller 42 sandwiches the intermediate transfer belt 44 therebetween. The cleaning frame 101 includes an accommodating portion 109 that accommodates the brush roller 103 therein and an accommodating portion 110 that accommodates the screw 104 therein.

The accommodating portion 109 has a generally hollow cylindrical shape. The accommodating portion 109 extends in the right-left direction and has closed ends in the right-left direction. The accommodating portion 109 has an opening in a lower end portion thereof. The opening is elongated across the lower end portion of the accommodating portion 109 in the right-left direction and penetrates the accommodating portion 109 in the up-down direction.

As depicted in FIG. 1, the accommodating portion 110 has a generally hollow cylindrical shape. The accommodating portion 110 extends in the right-left direction and has a closed left end. The accommodating portion 110 is disposed in front of the accommodating portion 109 such that the inside of the accommodating portion 110 is in communication with the inside of the accommodating portion 109. A diameter of the accommodating portion 110 is smaller than a diameter of the accommodating portion 109.

The cleaning blade 102 is disposed at a lower front end portion of the accommodating portion 109. The cleaning blade 102 has a thickness in an obliquely downward direction from its upper surface toward the front. The cleaning blade 102 has a generally plate shape extending in the right-left direction. The accommodating portion 109 has an opening that penetrates a lower end portion thereof so as to provide communication between the inside and the outside of the accommodating portion 109. An upper front portion of the cleaning blade 102 is fixed to a front circumferential edge portion of the opening of the accommodating portion 109. A lower rear portion of the cleaning blade 102 protrudes relative to a front end of the front circumferential edge portion of the opening and extends to an approximately front half of the opening of the accommodating portion 109. A lower rear end portion of the cleaning blade 102 is in contact with an upper rear end portion of the intermediate transfer belt 44.

The brush roller 103 is disposed inside the accommodating portion 109. The brush roller 103 extends in the right-left direction and has hair-like pieces or bristles on its surface.

The screw 104 is disposed inside the accommodating portion 110. The screw 104 may be an auger screw extending in the right-left direction.

As depicted in FIGS. 1 and 4, the connecting tube 105 extends obliquely downward toward the front. The connecting tube 105 has a generally hollow cylindrical shape having a closed upper end and a closed lower end. The connecting tube 105 has an opening that penetrates a right wall of an upper end portion thereof in the right-left direction. The upper end portion of the connecting tube 105 is connected to a right end portion of the accommodating portion 110. Thus, the inside of the connecting tube 105 is in communication with the inside of the accommodating portion 110. The connecting tube 105 has another opening that penetrates a left wall of a lower end portion thereof in the right-left direction.

The screw 106 is disposed in the lower end portion of the connecting tube 105. The screw 106 may be an auger screw extending in the right-left direction.

The residual toner box 107 has a protruding portion protruding upward at an upper end portion. The residual toner box 107 has a generally box shape extending both in the up-down direction and in the front-rear direction. The residual toner box 107 has an opening that penetrates a right wall of the protruding portion in the right-left direction. The protruding portion of the residual toner box 107 is connected to the lower end portion of the connecting tube 105. Thus, the inside of the residual toner box 107 is in communication with the inside of the connecting tube 105.

(2) Configuration of Frames of Casing

As depicted in FIG. 2, the casing 2 includes right and left side plates 111, right and left frames 112, upper and lower connecting plates 113, right and left positioning plates 114, and right and left base portions 115.

As depicted in FIGS. 2 and 6, the side plates 111 are spaced apart from each other in the right-left direction. The side plates 111 have a generally rectangular plate shape in side view and extend in the front-rear direction. The left side plate 111 is an example of a first side plate. The right side plate 111 is an example of a second side plate.

The right and left frames 112 are disposed closer to the center of the printer 1 than the right and left side plates 111, respectively. That is, the right and left frames 112 are disposed between the right and left side plates 111. The frames 112 have a generally box shape. An outer end portion of each frame 12 in the right-left direction is contiguous to an inner surface of a corresponding one of the side plates 111, thereby defining an accommodation space 117.

As depicted in FIG. 1 and FIG. 2, one (e.g., the upper connecting plate 113) of the connecting plates 113 is disposed extending between an upper end portion of the right side plate 111 and an upper end portion of the left side plates 111. The other (e.g., the lower connecting plate 113) of the connecting plates 113 is disposed extending between a lower end portion of the right side plate 111 and a lower end portion of the left side plate 111. The upper connecting plate 113 is disposed below the exposing device 15 in an upper portion of the casing 2. The upper connecting plate 113 has a generally rectangular plate shape in plan view in the front-rear direction. The lower connecting plate 113 is disposed below the belt unit 40 in a lower portion of the casing 2. The lower connecting plate 113 has a generally rectangular plate shape in plan view. The lower connecting plate 113 is inclined upward toward the front so as to extend along a lower portion of the intermediate transfer belt 44.

As depicted in FIGS. 2 and 4, one (e.g., the left positioning plate 114) of the positioning plates 114 is disposed on an upper surface of the lower connecting plate 113 and to the left of the belt unit 40. The other (e.g., the right positioning plate 114) of the positioning plates 114 is disposed on the upper surface of the lower connecting plate 113 and to the right of the belt unit 40. The positioning plates 114 have a generally rectangular plate shape in side view extending in the front-rear direction. Lower end portions of the positioning plates 114 are bent toward the right. Lower ends of the positioning plates 114 are inclined upward toward the front along the inclined lower connecting plate 113. Upper ends of the positioning plates 114 extend along the front-rear direction. The positioning plates 114 each have a plurality of, for example, four, positioning recesses 121.

As depicted in FIG. 4, the positioning recesses 121 are arranged side by side in the front-rear direction while being spaced apart from each other in the front-rear direction. The positioning recesses 121 are recessed downward relative to the upper end of the positioning plate 114 and have a generally arc shape in side view. The positioning recesses 121 each have a shape corresponding to the periphery of a corresponding flange support portion 70 of the cartridge frame 64.

Figure 5:
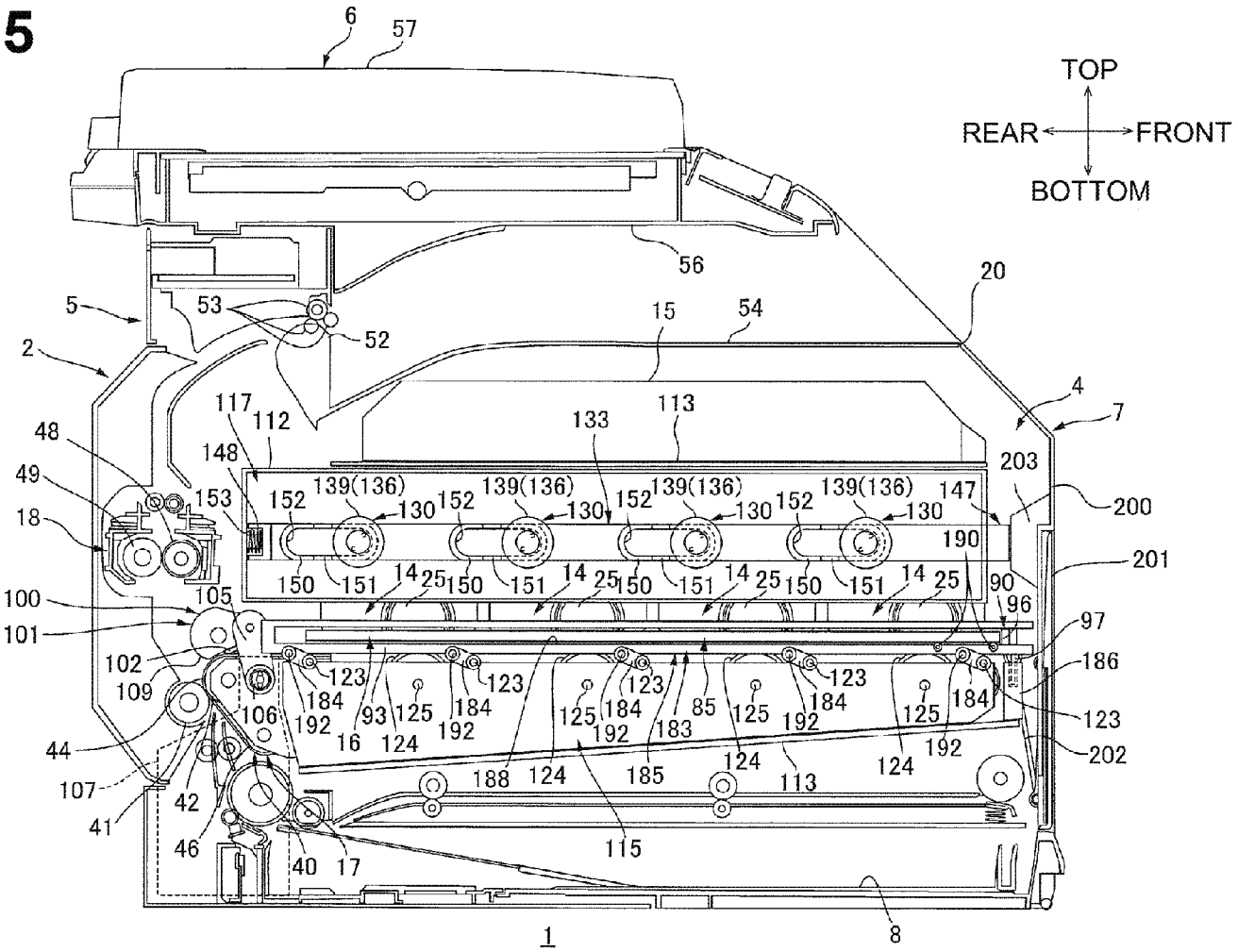
FIG. 5 is a sectional view taken along line C-C of the printer of FIG. 2 in the first illustrative embodiment according to one or more aspects of the disclosure.

As depicted in FIGS. 2 and 5, one (e.g., the left base portion 115) of the base portions 115 is disposed on the upper surface of the lower connecting plate 113 and to the left of the left positioning plate 114. The other (e.g., the right base portion 115) of the base portions 115 is disposed on the upper surface of the lower connecting plate 113 and to the right of the right positioning plate 114. The base portions 115 have a generally rectangular thick plate shape in side view extending in the front-rear direction. Lower ends of the base portions 115 extend obliquely upward toward the front along the inclined lower connecting plate 113. Upper ends of the base portions 115 extend along the front-rear direction. The base portions 115 each include a plurality of, for example, five, base shafts 123. The left base portion 115 further includes a plurality of, for example, four, drum gears 124 and a plurality of, for example, four, drum gear shafts 125.

As depicted in FIG. 5, the base shafts 123 are disposed at an upper end portion of a substantially middle portion in the right-left direction of the base portions 115. The base shafts 123 are arranged side by side in the front-rear direction while being spaced apart from each other in the front-rear direction. The base shafts 123 have a generally cylindrical column shape extending in the right-left direction.

As depicted in FIG. 4, the drum gears 124 are spaced apart from each other in the front-rear direction. As depicted in FIGS. 2 and 4, the drum gears 124 are disposed below the left flanges 27 of the photosensitive drums 25, respectively, in a state where the process cartridges 14 are located inside the casing 2. As described above, the lower end portions of the left flanges 27 of the photosensitive drums 25 are not covered by the respective flange support portions 70.

The drum gear shafts 125 extend in the right-left direction from the left base portion 115 toward the centers of the drum gears 124, respectively. The drum gear shafts 125 have a generally cylindrical column shape. Each of the drum gear shafts 125 passes through a middle portion of a corresponding drum gear 124 in its diameter direction so as not to rotate relative to the drum gear 124.

This configuration may enable transmission of driving force from a drive source (not depicted) to the drum gears 124 via the respective drum gear shafts 125.

(3) Configuration for Inputting Driving Force and Supplying Electric Power to Developing Units of Casing As depicted in FIGS. 2 and 6, the casing 2 further includes a plurality of, for example, four, driving-force input members 130, a power supply board 131, a plurality of, for example, four, electric-power supply members 132, and right and left movable members 133.

The driving-force input members 130 are spaced apart from each other in the front-rear direction such that the driving-force input members 130 are positioned to the left of the respective driving-force receiving members 37. All of the driving-force input members 130 have the same or similar configuration, and therefore, one of the driving-force input members 130 will be described in detail. A driving-force input member 130 has a body portion 136, a spring 137, and an input gear 138.

The body portion 136 has a generally cylindrical column shape extending in the right-left direction. The body portion 136 has a left end portion DE1 and a right end portion DE2. The body portion 136 penetrates the left side plate 111 and the left frame 112 in the right-left direction. Therefore, the left end portion DE1 of the body portion 136 is located further to the left than the left side plate 111 and the right end portion DE2 of the body portion 136 is located further to the right than the left frame 112. That is, a middle portion of the body portion 136 in the right-left direction is located within the accommodation space 117 defined by the left side plate 111 and the left frame 112. The left end portion DE1 of the body portion 136 is an example of a first end portion of the driving-force input member 130. The right end portion DE2 of the body portion 136 is an example of a second end portion of the driving-force input member 130. That is, as depicted in FIG. 10, the right end portion DE2 of the driving-force input member 130 is located between the left guide rail 185 and the right guide rail 185 when viewed in the up-down direction in a state where the driving-force input member 130 is located at a disengaged position. As depicted in FIGS. 2 and 6, the body portion 136 includes an annular portion 139.

The annular portion 139 has a generally ring shape. The annular portion 139 protrudes from a substantially middle portion of the body portion 136 in the right-left direction, e.g., a portion of the body portion 136 located within the accommodation space 117, toward the exterior of the printer 1 in a diameter direction of the body portion 136 and extends in its circumferential direction.

The spring 137 may be a coil-shaped spring of a helically wound wire extending along the right-left direction. The spring 137 is attached to the body portion 136 in a contracted state while one end portion of the spring 137 is in contact with the left side plate 111 and the other end portion of the spring 137 is in contact with the annular portion 139. Therefore, the spring 137 urges the body portion 136 rightward at all times.

The input gear 138 is disposed at a left surface of the left side plate 111. The input gear 138 has a generally cylindrical shape extending in the right-left direction. The input gear 138 includes a flange portion that protrudes from a right end portion of the input gear 138 in its diameter direction and extends in its circumferential direction. The flange portion of the right end portion of the input gear 138 has gear teeth on its circumferential surface. The input gear 138 accommodates a portion of the body portion 136 therein and is capable of transmitting a driving force from the drive source (not depicted) to the body portion 136.

Figure 8:
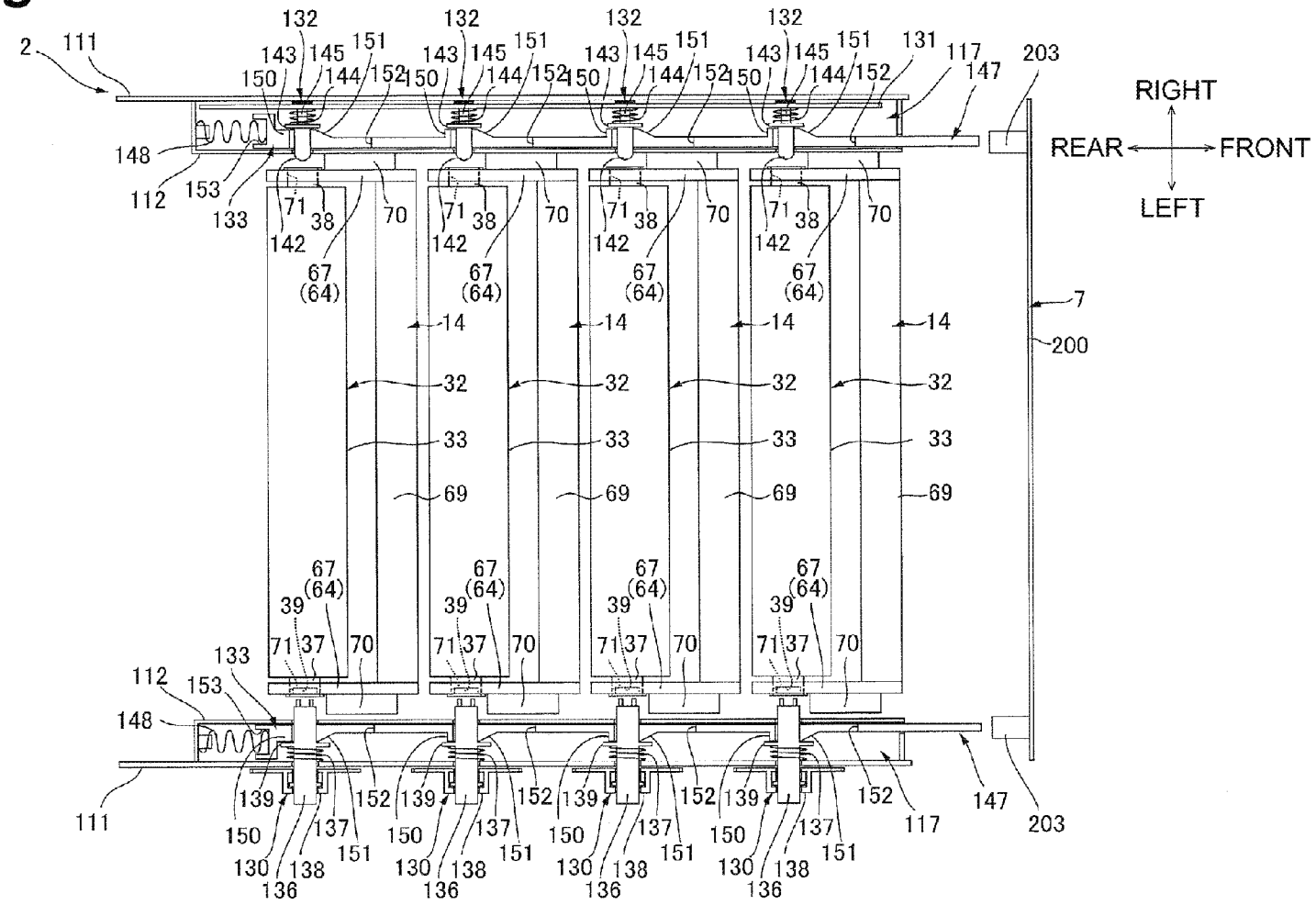
FIG. 8 is a sectional view depicting the printer of FIG. 6 in the first illustrative embodiment according to one or more aspects of the disclosure, wherein the protrusion of the front cover and the translation cam are disengaged from each other.

The driving-force input member 130 is configured to move in the right-left direction between an engaged position (e.g., a position of the driving-force input member 130 depicted in FIGS. 2 and 6) and a disengaged position (e.g., a position of the driving-force input member 130 depicted in FIGS. 8 and 10). When the driving-force input member 130 is located at the engaged position (refer to FIGS. 2 and 6), the driving-force input member 130 is able to transmit a driving force from the drive source (not depicted) to a corresponding developing unit 32. When the driving-force input member 130 is located at the disengaged position (refer to FIGS. 8 and 10), the driving-force input member 130 does not transmit a driving force to the corresponding developing unit 32. The driving-force input member 130 located at the engaged position is configured to be able to input a driving force to the corresponding driving-force receiving member 37 while being in engagement with the corresponding driving-force receiving member 37. The driving-force input member 130 located at the disengaged position is configured not to engage with the corresponding driving-force receiving member 37.

As depicted in FIGS. 2 and 6, the power supply board 131 is disposed adjacent to the right side plate 111 in the right accommodation space 117. The power supply board 131 has a generally rectangular plate shape in side view extending in the front-rear direction. The power supply board 131 may be a circuit board including, for example, a transformer and a capacitor. The power supply board 131 is configured to amplify voltage supplied from an input power source (not depicted) using the transformer and store the amplified voltage in the capacitor. The power supply board 131 is further configured to supply electric power to the electric-power supply members 132.

The electric-power supply members 132 are disposed to the right of the respective electrode members 38 while being spaced apart from each other in the front-rear direction. All of the electric-power supply members 132 have the same or similar configuration, and therefore, one of the electric-power supply members 132 will be described in detail. An electric-power supply member 132 has a fixed portion 145, a body portion 142, and a spring 143.

The fixed portion 145 has a generally cylindrical column shape extending in the right-left direction. The fixed portion 145 has a right end portion PE1. The fixed portion 145 is supported by the right side plate 111 while the right end portion PE1 penetrates and protrudes from the power supply board 131. The right end portion PE1 of the fixed portion 145 is an example of a first end portion of the electric-power supply member 132.

The body portion 142 extends in the right-left direction and has a generally cylindrical shape with its left end closed.

The body portion 142 is attached to the fixed portion 145 from the left and penetrates the right frame 112 in the right-left direction. The body portion 142 has a left end portion PE2. While a right end portion of the body portion 142 is positioned within the accommodation space 117, the left end portion PE2 of the body portion 142 is located further to the left than the right frame 112. The left end portion PE2 is an example of a second end portion of the body portion 142. That is, as depicted in FIG. 10, the left end portion PE2 of the electric-power supply member 132 is located between the left guide rail 185 and the right guide rail 185 when viewed in the up-down direction in a state where the electric-power supply member 132 is located at a non-contacting position. As depicted in FIGS. 2 and 6, the body portion 142 includes an annular portion 144.

The annular portion 144 has a generally ring shape. The annular portion 144 protrudes from a right end portion of the body portion 142, e.g., a portion of the body portion 142 located within the accommodation space 117, toward the exterior of the printer 1 in a diameter direction of the body portion 142 and extends in its circumferential direction.

The spring 143 has conductivity. The spring 143 may be a coil-shaped spring of a helically wound wire extending along the right-left direction. The spring 143 is attached to the fixed portion 145 in a contracted state while one end portion of the spring 142 is in contact with the power supply board 131 and the other end portion of the spring 142 is in contact with the annular portion 144. Therefore, the spring 143 urges the body portion 142 leftward at all times.

The electric-power supply member 132 is configured to move between a contacting position (e.g., a position of the electric-power supply member 132 depicted in FIGS. 2 and 6) and a non-contacting position (e.g., a position of the electric-power supply member 132 depicted in FIGS. 8 and 10). When the electric-power supply member 132 is located at the contacting position (refer to FIGS. 2 and 6), the electric-power supply member 132 is in contact with a corresponding electrode member 38. When the electric-power supply member 132 is located at the non-contacting position (refer to FIGS. 8 and 10), the electric-power supply member 132 is not in contact with the corresponding electrode member 38. The electric-power supply member 132 located at the contacting position is configured to supply electric power to the corresponding electrode member 38 while being in contact with the corresponding electrode member 38. The electric-power supply member 132 located at the non-contacting position is configured to not contact with the corresponding electrode member 38.

As depicted in FIGS. 2 and 6, one (e.g., the left movable member 133) of the movable members 133 is disposed within the left accommodation space 117, and the other (e.g., the right movable member 133) of the movable members 133 is disposed within the right accommodation space 117. Both of the movable members 133 have the same or similar configuration, and therefore, one of the movable members 133 will be described in detail. A movable member 133 has a translation cam 147 and a spring 148.

The translation cam 147 has a generally plate shape extending in the front-rear direction. The translation cam 147 includes a plurality of, for example, four, protruding portions 150, a plurality of, for example, four, inclined portions 151, and an accommodating portion 153. The translation cam 147 further has a plurality of, for example, four, elongated holes 152 therein.

The protruding portions 150 are spaced apart from each other in the front-rear direction. Spacing between each protruding portion 150 in the front-rear direction in the translation cam 147 of the left movable member 133 is the same as spacing between each driving-force receiving member 37 in the front-rear direction. Spacing between each protruding portion 150 in the front-rear direction in the right translation cam 147 of the right movable member 133 is the same as spacing between each electrode member 38 in the front-rear direction. The protruding portions 150 have a generally rectangular shape. The protruding portions 150 protrude from an outer surface of the translation cam 147 of the movable member 133 toward the exterior of the printer 1 in the right-left direction.

Each of the inclined portions 151 is inclined toward the center of the printer 1 in the right-left direction from a front end of a corresponding protruding portions 150. The inclined portions 151 have a generally triangular shape in plan view and are contiguous to the outer surface of the translation cam 147 in the right-left direction.

As depicted in FIGS. 5 and 6, the elongated holes 152 are spaced apart from each other in the front-rear direction and penetrate the translation cam 147 in the right-left direction. More specifically, each of the elongated holes 152 is elongated frontward from a rear end of a corresponding one of the protruding portions 150 in side view. The elongated hole 152 is elongated to a position further to the front than a corresponding inclined portion 151.

The accommodating portion 153 is recessed frontward relative to a rear end surface of the translation cam 147. The accommodating portion 153 has a generally rectangular shape in rear view.

The spring 148 may be a coil-shaped spring of a helically wound wire extending along the front-rear direction. The spring 148 is disposed in a contracted state in the accommodating portion 153 while one end portion of the spring 148 is in contact with a front surface of the accommodating portion 153 and the other end portion of the spring 148 is in contact with a rear wall of the frame 112. Therefore, the spring 148 urges the translation cam 147 frontward at all times.

The right movable member 133 is configured to move between in the front-rear direction between a driving-force supply side first position (e.g., a position of the right movable member 133 depicted in FIGS. 2 and 6) and a driving-force supply side second position (e.g., a position of the right movable member 133 depicted in FIGS. 8 and 10). When the right movable member 133 is located at the driving-force supply side first position, the right movable member 133 retains the driving-force input members 130 at the engaged position. When the right movable member 133 is located at the driving-force supply side second position, the right movable member 133 retains the driving-force input members 130 at the disengaged position. The right movable member 133 is an example of a first movable member.

The left movable member 133 is configured to move in the front-rear direction between an electric-power supply side first position (e.g., a position of the left movable member 133 depicted in FIGS. 2 and 6) and an electric-power supply side second position (e.g., a position of the left movable member 133 depicted in FIGS. 8 and 10). When the left movable member 133 is located at the electric-power supply side first position, the left movable member 133 retains the electric-power supply members 132 at the contacting position. When the left movable member 133 is located at the electric-power supply side second position, the left movable member 133 retains the electric-power supply members 132 at the non-contacting position. The left movable member 133 is an example of a second movable member.

(4) Configuration for Moving Drawer Relative to Casing

As depicted in FIGS. 2 and 5, the casing 2 further includes a guide unit 183 and an engagement portion 186.

The guide unit 183 includes right and left guide rails 185 and a plurality of link portions 184. The link portions 184 are grouped into five pairs, and each pair includes a right link portion 184 and a left link portion 184.

Figure 9:
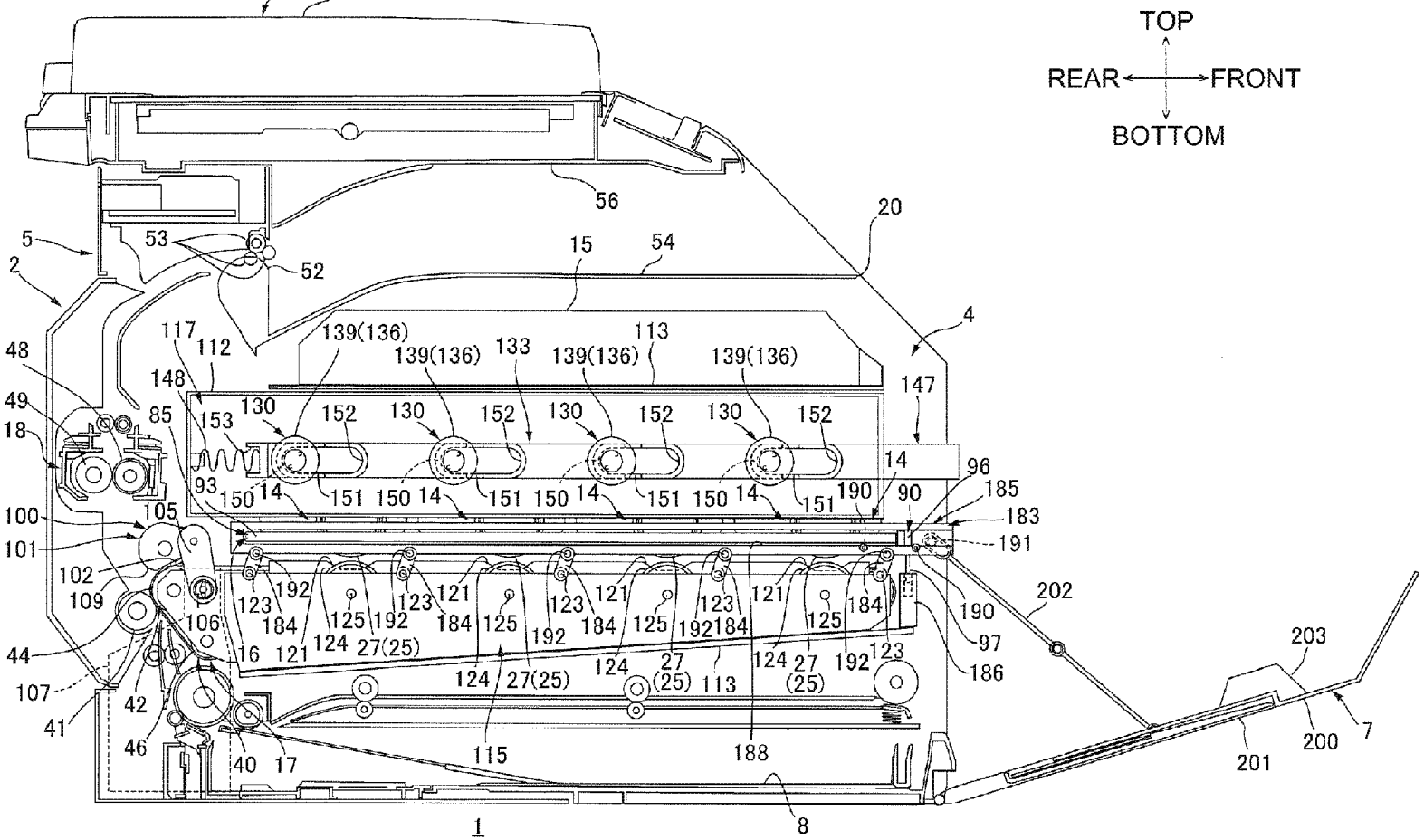
FIG. 9 is a sectional view depicting the printer of FIG. 5 in the first illustrative embodiment according to one or more aspects of the disclosure, wherein the front cover is located at an exposing position and the drawer is located at a distant position of the inside position.

One (e.g., the left guide rail 185) of the guide rails 185 is disposed below the left frame 112 and above the left base portion 115 while being disposed further to the right than the left side plate 111. The other (e.g., the right guide rail 185) of the guide rails 185 is disposed below the right frame 112 and above the right base portion 115 while being disposed further to the left than the right side plate 111. Both of the right and left guide rails 185 have the same or similar configuration, and therefore, one of the guide rails 185 will be described in detail. A guide rail 185 has a generally rectangular column shape in the front-rear direction. As depicted in FIGS. 2 and 9, the guide rail 185 has a first guide groove 188 and a second guide groove 189 and further includes a plurality of, for example, two, rollers 190, an engagement shaft 191, and a plurality of, for example, five, guide rail shafts 192.

The first guide groove 188 is recessed relative to an inner surface of the guide rail 185 in the right-left direction toward the exterior of the printer 1 in the right-left direction (e.g., rightward or leftward). The first guide groove 188 extends from a rear end portion of the guide rail 185 to a front end of the guide rail 185 so as to have an opening at its front end. The first guide groove 188 has a generally rectangular shape in sectional view.

As depicted in FIG. 2, the second guide groove 189 is recessed relative to an inner surface (e.g., a right surface or a left surface) of the first guide groove 188 in the right-left direction toward the exterior of the printer 1 in the right-left direction (e.g., rightward or leftward) at a substantially middle portion of the first guide groove 188 in the up-down direction. The second guide groove 189 extends from a rear end portion of the guide rail 185 to the front end of the guide rail 185 so as to have an opening at its front end. The second guide groove 189 has a generally rectangular shape in sectional view.

As depicted in FIGS. 2 and 5, the rollers 190 are configured to rotate on respective axes extending in the right-left direction. The rollers 190 are disposed such that their upper end portions are located higher than a lower surface of a front end portion of the first guide groove 188. The rollers 190 are disposed side by side in the front-rear direction.

As depicted in FIG. 9, the engagement shaft 191 has a generally cylindrical column shape. The engagement shaft 191 protrudes from an outer surface (e.g., a right surface or a left surface) of the front end portion of the guide rail 185 in the right-left direction toward the exterior of the printer 1 in the right-left direction (e.g., rightward or leftward). The engagement shafts 191 of the guide rails 185 are in engagement with movable end portions of an interlock portion 202 of the front cover 7.

As depicted in FIGS. 5 and 9, the guide rail shafts 192 are spaced apart from each other in the front-rear direction at a lower end portion of a substantially middle portion of the guide rail 185 in the right-left direction. The guide rail shafts 192 have a generally cylindrical column shape extending in the right-left direction. Spacing between each guide rail shaft 192 in the front-rear direction is the same as spacing between each base shafts 123 in the front-rear direction.

The left guide rail 185 is an example of a first guide member. The right guide rail 185 is an example of a second guide member.

The paired link portions 184 are spaced apart from each other in the front-rear direction. The link portions 184 have generally bar shape extending obliquely downward toward the front in a state where the process cartridges 14 are located at the first position as depicted in FIG. 5. Each of the link portions 184 has an opening having a generally circular shape in side view. Each of the openings penetrates one end portion of a corresponding link portion 184 and allows a corresponding base shaft 123 to pass therethrough such that the base shaft 123 is rotatable relative to the link portion 184. Each of the link portions 184 has another opening having a generally circular shape in side view. Each of the openings penetrates the other end portion of the corresponding link portion 184 and allows a corresponding guide rail shaft 192 to pass therethrough such that the guide rail shaft 192 is rotatable relative to the link portion 184.

As depicted in FIG. 1, the engagement portion 186 is disposed at a substantially middle portion in the right-left direction between the right and left guide rails 185. The engagement portion 186 has a generally thick plate shape having a generally U-shaped cutout in side view. The engagement portion 186 has an upper open end.

As depicted in FIGS. 1 and 5, the front cover 7 includes a body portion 200, a manual feed tray 201, and the interlock portion 202.

The body portion 200 has a generally rectangular plate shape in front view extending in the up-down direction. The body portion 200 includes an inclined portion at its upper end portion. The inclined portion of the body portion 200 is inclined toward the rear. The body portion 200 has a size that is capable of closing the opening 20. As depicted in FIGS. 5 and 6, the body portion 200 includes right and left protrusions 203.

The right and left protrusions 203 are spaced apart from each other in the right-left direction. Spacing between the right and left protrusions 203 in the right-left direction is substantially the same as spacing between the right and left translation cams 147 in the right-left direction. The protrusions 203 have a generally trapezoidal plate shape in side view and protrude rearward from a rear surface of the body portion 200.

As depicted in FIG. 1, the manual feed tray 201 is disposed at a substantially middle portion of the body portion 200 in the up-down direction. The manual feed tray 201 has a generally rectangular plate shape in side view extending in the right-left direction. The manual feed tray 201 is configured to pivot on a lower end portion of the body portion 200 and tilt toward the front from an upright position.

Figure 7:
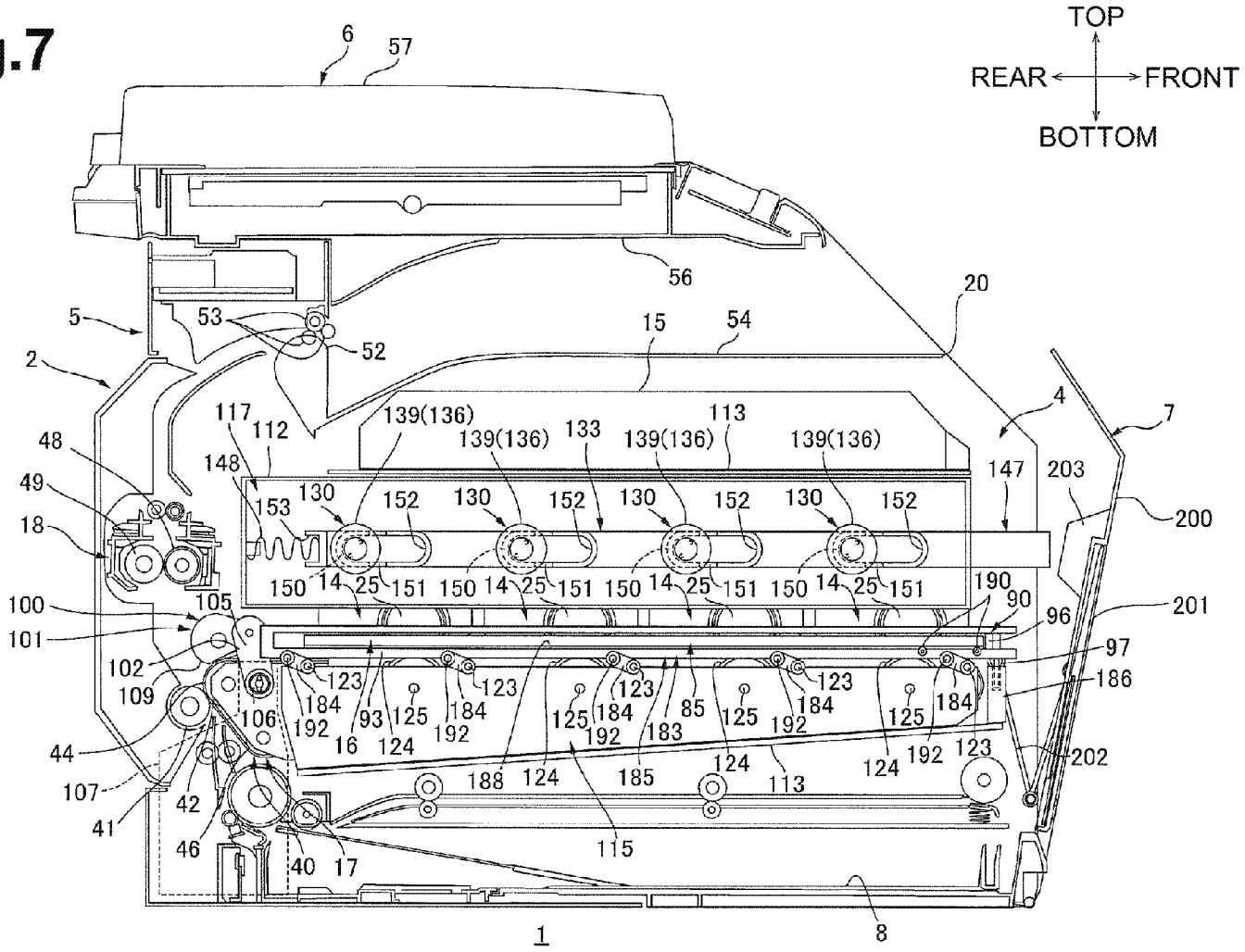
FIG. 7 is a sectional view depicting the printer of FIG. 5 in the first illustrative embodiment according to one or more aspects of the disclosure, wherein a protrusion of a front cover and a translation cam are disengaged from each other.

As depicted in FIGS. 7 and 9, the interlock portion 202 has a generally bar shape. The interlock portion 202 is capable of bending at a substantially middle portion thereof in its longitudinal direction. The interlock portion 202 has base ends connected to a substantially middle portion of the body portion 200 in the up-down direction. As described above, the movable end portions of the interlock portion 202 are in engagement with the engagement shafts 191 of the guide rails 185, respectively.

5. Installed State of Process Cartridges in Casing

As depicted in FIGS. 1 and 4, in a state where all of the process cartridges 14 are installed in the casing 2, the drawer 16 is located at the adjacent position of the inside position, the stopper 90 is located at the restricting position, the process cartridges 14 are located at the first position, and the front cover 7 is located at the closing position.

Further, the driving-force input members 130 are located at the engaged position, the left movable member 133 is located at the driving-force supply side first position, the electric-power supply members 132 are located at the contacting position, and the right movable member 133 is located at the electric-power supply side second position.

The process cartridges 14 are placed on the support surfaces 94 of the recessed portions 88, respectively, of the bottom plate 85. More specifically, the process cartridges 14 are supported by the support surfaces 94 of the recessed portions 88, respectively, such that the lower end portions of the photosensitive drums 25 protrude through the respective openings 91. Thus, the process cartridges 14 are left exposed from the bottom plate 85 in side view.

As depicted in FIG. 4, of a projected plane of a process cartridge 14 in side view, an area of a portion that overlaps the bottom plate 85 may be between 3% and 30% inclusive, preferably between 5% and 10% inclusive, of a total area of the projected plane of the process cartridge 14.

As depicted in FIG. 2, the drawer 16 is located inside the casing 2 while being supported such that the left thin-plate portion 93 is received by the first guide groove 188 of the left guide rail 185, the right thin-plate portion 93 is received by the first guide groove 188 of the right guide rail 185, the left rollers 89 are received by the second guide groove 189 of the left guide rail 185, and the right rollers 89 are received by the second guide groove 189 of the right guide rail 185.

In this state, the driving-force input members 130 and the electric-power supply members 132 are located above the bottom plate 85.

The left movable member 133 overlaps the left thin-plate portion 93 of the bottom plate 85 when projected in the up-down direction. The right movable member 133 overlaps the right thin-plate portion 93 of the bottom plate 85 when projected in the up-down direction.

The stopper 90 of the drawer 16 is located at the restricting position. Thus, the projecting portion 97 is in engagement with the engagement portion 186 to restrict movement of the drawer 16 in the front-rear direction.

As depicted in FIG. 5, the drawer 16 supporting the process cartridges 14 is located adjacent to the intermediate transfer belt 44 (e.g., at the adjacent position) by its own weight. In this state, the link portions 184 extend upward and rearward from the respective base shafts 123.

As depicted in FIGS. 2 and 4, the flange support portions 70 of the process cartridges 14 are engaged with the respective positioning recesses 121 of the positioning plate 114.

The lower portions of the left flanges 27 of the photosensitive drums 25 are in mesh with the upper end portions of the drum gears 124, respectively.

As described above, the photosensitive drums 25 are placed at their positions by the right and left positioning plates 114 such that the photosensitive drums 25 are in contact with the outer surface of the upper portion of the intermediate transfer belt 44.

As depicted in FIGS. 5 and 6, the front cover 7 is located at the closing position. In this state, the front end portion of the translation cam 147 of the left movable member 133 is in contact with the left protrusion 203, whereby the translation cam 147 of the left movable member 133 is located at a rearward position against an urging force of the spring 148. The front end portion of the translation cam 147 of the right movable member 133 is also in contact with the right protrusion 203, whereby the translation cam 147 of the right movable member 133 is located at a rearward position against an urging force of the spring 148.

Thus, as depicted in FIG. 6, the body portion 136 of each of the driving-force input members 130 is positioned at a front end portion of a corresponding one of the elongated holes 152 of the left translation cam 147. In this state, each of the driving-force input members 130 is in engagement with the hole 39 of a corresponding one of the driving-force receiving members 37 by application of an urging force to each of the body portions 136 by a corresponding one of the springs 137.

The body portion 142 of each of the electric-power supply members 132 is positioned at a front end portion of a corresponding one of the elongated holes 152 of the right translation cam 147. In this state, the left end portion PE2 of the body portion 142 of each of the electric-power supply members 132 is in contact with the electrode member 38 of a corresponding one of the process cartridges 14 by application of an urging force to each of the body portions 142 by a corresponding one of the springs 143.

6. Procedure for Detaching Process Cartridges (1) Opening of Front Cover

In order to detach a process cartridge 14 from the casing 2, as depicted in FIG. 7, the front cover 7 is pivoted from the closing position toward the exposing position. In response to this, the left protrusion 203 of the front cover 7 is disengaged from the front end of the translation cam 147 of the left movable member 133 and the right protrusion 203 of the front cover 7 is disengaged from the front end of the translation cam 147 of the right movable member 133.

Thus, the left translation cam 147 is moved frontward by an urging force of the left spring 148, and therefore, as depicted in FIG. 8, the left movable member 133 is located at the driving-force supply side second position. Further, the right translation cam 147 is moved frontward by an urging force of the right spring 148, and therefore, the right movable member 133 is located at the electric-power supply side second position.

While the left translation cam 147 is moved as described above, the left translation cam 147 moves the body portions 136 of the driving-force input members 130 leftward against the urging force of the respective springs 137 such that the left translation cam 147 causes the annular portions 139 of the driving-force input members 130 to slide over the respective inclined portions 151.

Therefore, the annular portions 139 of the driving-force input members 130 are positioned in contact with the left surfaces of the protruding portions 150, respectively.

In this state, as depicted in FIG. 10, the right end portion DE2 of the body portion 136 of each of the driving-force input members 130 is located further to the right than the left guide rail 185 and overlaps the left end portion of the thick plate portion 92 of the bottom plate 85 when projected in the up-down direction.

As described above, the body portions 136 are disengaged from the respective holes 39 and the driving-force input members 130 are located at the disengaged position. In other words, in a state where the driving-force input members 130 are located at the disengaged position, the right end portions DE2 of the body portions 136 are located between the right and left guide rails 185 when projected in the up-down direction.

While the right translation cam 147 is moved as described above, the right translation cam 147 moves the body portions 142 of the electric-power supply members 132 rightward against the urging force of the respective springs 143 such that the right translation cam 147 causes the annular portions 144 of the electric-power supply members 132 to slide over the respective inclined portions 151.

Therefore, the annular portions 144 of the electric-power supply members 132 are positioned in contact with the right surfaces of respective protruding portions 150.

In this state, as depicted in FIG. 10, the left end portion PE2 of the body portion 142 of each of the electric-power supply members 132 is located further to the left than the right guide rail 185 and overlaps the right end portion of the thick plate portion 92 of the bottom plate 85 when projected in the up-down direction.

As described above, the body portions 142 are separated from the respective electrode members 38 and the electric-power supply members 132 are located at the non-contacting position. In other words, in a state where the electric-power supply members 132 are located at the non-contacting position, the left end portion PE2 of the body portion 142 is located between the right and left guide rails 185 when projected in the up-down direction.

(2) Up and Down Movement of Drawer at Inside Position

Then, as depicted in FIG. 9, the front cover 7 is further pivoted toward the exposing position and thus is located at the exposing position.

In response to the movement of the front cover 7 from the closing position to the exposing position, a tension is applied to the interlock portion 202 and thus the guide rails 185 are pulled frontward via the interlock portion 202. Therefore, the link portions 184 pivot clockwise in left side view on the respective base shafts 123 and thus the guide rails 185 move upward and frontward.

At that time, the movement of the drawer 16 in the front-rear direction is restricted by the engagement of the projecting portion 97 of the stopper 90 with the engagement portion 186. Therefore, the drawer 16 might not be able to move frontward but may move upward only inside the casing 2 in response to the forward movement of the guide rails 185.

As described above, the drawer 16 is retained at the distant position at which the drawer 16 is located at a distance from the intermediate transfer belt 44.

In response to the upward movement of the drawer 16, the flange support portions 70 of the process cartridges 14 are separated from the respective positioning recesses 121 of the positioning plate 114.

The left flanges 27 of the photosensitive drums 25 are also disengaged from the respective drum gears 124.

(3) Pulling Out of Drawer

As indicated by the dashed line in FIG. 3, the stopper 90 of the drawer 16 is moved to the non-restricting position. In response to this, the projecting portion 97 is disengaged from the engagement portion 186.

Figure 11:
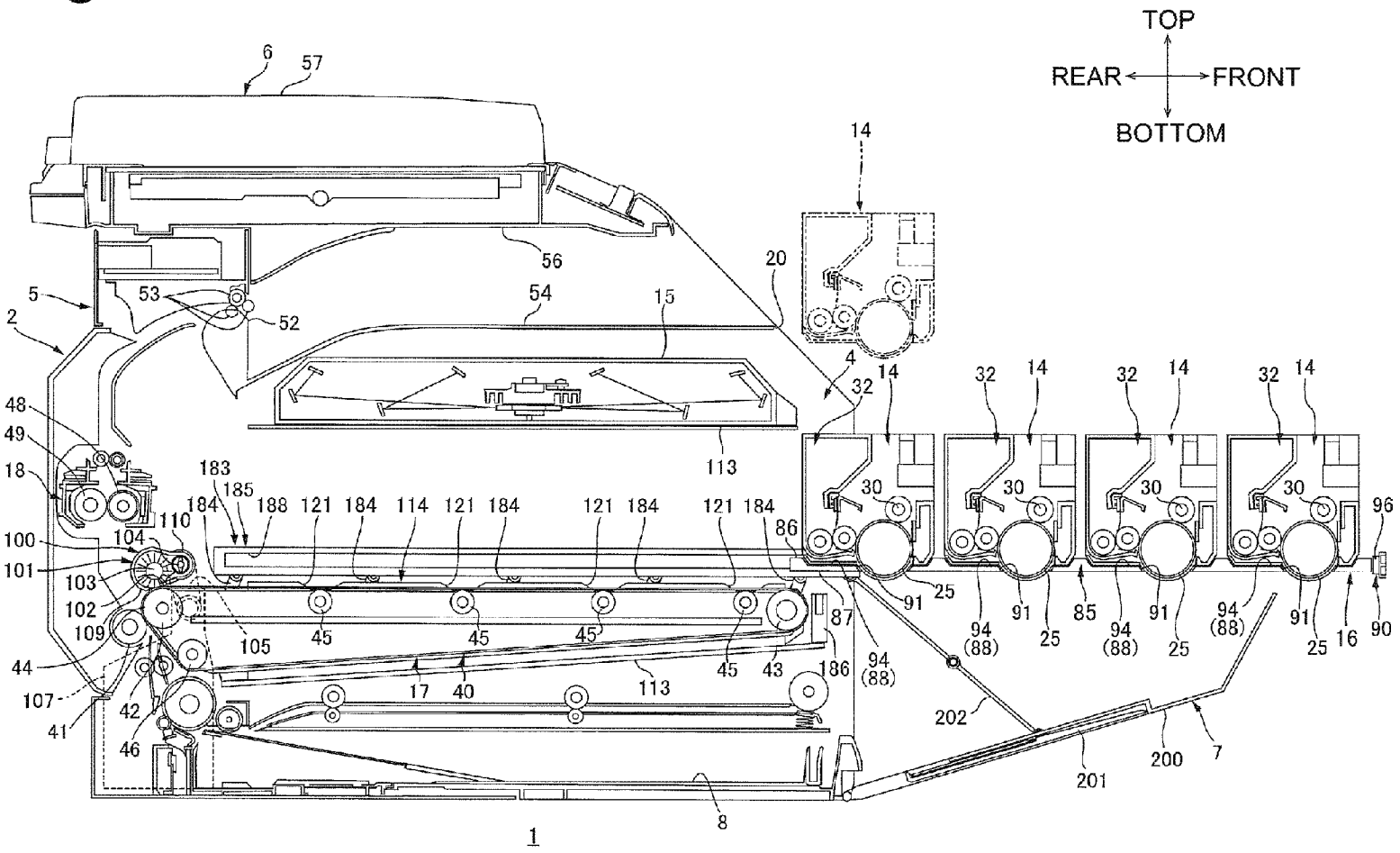
FIG. 11 is a sectional view depicting the printer of FIG. 1 in the first illustrative embodiment according to one or more aspects of the disclosure, wherein the drawer is located at an outside position.

Then, as depicted in FIG. 11, the drawer 16 is pulled frontward through the opening 20.

At that time, the drawer 16 moves frontward while the left thin-plate portion 93 of the bottom plate 85 is guided by the left first guide groove 188, the lower surface of the left thin-plate portion 93 is guided by rotation of the rollers 190 of the left guide rail 185, the right thin-plate portion 93 of the bottom plate 85 is guided by the first guide groove 188, and the lower surface of the right thin-plate portion 93 is guided by rotation of the rollers 190 of the right guide rail 185.

The rollers 89 of the drawer 16 are located within the second guide grooves 189. The movement of drawer 16 is guided by rotation of the rollers 89.

As described above, the drawer 16 is slid frontward and thus is retained at the outside position.

Thus, as indicated by a phantom line in FIG. 11, the process cartridges 14 are allowed to be detached from or attached to the drawer 16.

7. Procedure for Installing Process Cartridges

In order to install a process cartridge 14 in the casing 2, the detachment procedure is performed in a reverse order.

More specifically, as depicted in FIG. 11, the process cartridges 14 are placed on the support surfaces 94 of the recessed portions 88, respectively.

Then, the drawer 16 having the process cartridges 14 attached is slid rearward to the distant position of the inside position through the opening 20.

Thereafter, as depicted in FIG. 3, the stopper 90 of the drawer 16 is moved to the restricting position. Thus, as depicted in FIG. 9, the projecting portion 97 of the stopper 90 is engaged with the engagement portion 186.

After that, the front cover 7 is pivoted from the exposing position toward the closing position.

In response to the movement of the front cover 7 from the exposing position toward the closing position, as depicted in FIG. 7, a tension applied to the interlock portion 202 decreases and thus the guide rails 185 move downward by their own weight. Therefore, the link portions 184 pivot counterclockwise in side view on the respective base shafts 123 and thus the guide rails 185 move rearward and downward.

At that time, the movement of the drawer 16 in the front-rear direction is restricted by the engagement of the projecting portion 97 of the stopper 90 with the engagement portion 186. Thus, the drawer 16 might not be able to move further rearward within the casing 2 but may move downward only in response to the movement of the guide rails 185. The drawer 16 is retained at the adjacent position of the inside position.

Therefore, the flange support portions 70 of the process cartridges 14 come into engagement with the respective positioning recesses 121 and thus the process cartridges 14 are positioned at their particular positions while the drums 26 are in contact with the outer surface of the upper portion of the intermediate transfer belt 44.

Further, the left flanges 27 of the photosensitive drums 25 come into mesh with the respective drum gears 124.

Then, as depicted in FIGS. 5 and 6, the front cover 7 is further pivoted to the closing position. Thus, the left protrusion 203 of the front cover 7 comes into contact with the front end of the translation cam 147 of the left movable member 133, whereby the translation cam 147 moves rearward against an urging force of the spring 148. The right protrusion 203 of the front cover 7 also comes into contact with the front end of the translation cam 147 of the right movable member 133, whereby the translation cam 147 moves rearward against an urging force of the spring 148.

In response to the rearward movement of the translation cam 147 of the left movable member 133, the left movable member 133 is moved to the driving-force supply side first position, whereby the driving-force input members 130 are positioned at the engaged position. In response to the rearward movement of the translation cam 147 of the right movable member 133, the right movable member 133 is moved the electric-power supply side first position, whereby the electric-power supply members 132 are positioned at the contacting position.

Thus, the installation of the process cartridges 14 into the casing 2 is completed.

8. Effects (1) According to the above-described printer 1, as depicted in FIGS. 1 and 3, the drawer 16 may be movable between the inside position and the outside position with respect to the casing 2 while the plate-like shaped bottom plate 85 having the support surfaces 94 supports the process cartridges 14.

The plate-like shape of the bottom plate 85 may enable the driving-force input members 130 and the electric-power supply members 132 to be disposed adjacent to the respective process cartridges 14 as depicted in FIGS. 2 and 6.

Therefore, the configuration of the drawer 16 may be simplified and the size of the drawer 16 may be reduced as compared with a case where the drawer 16 has a generally box shape for accommodating the process cartridges 14 therein.

Accordingly, while the movement of the process cartridges 14 between the inside position and the outside position with respect to the casing 2 is achieved using such a drawer 16, space saving may also be achieved inside the casing 2, whereby reducing the printer 1 in size.

(2) According to the above-described printer 1, as depicted in FIG. 4, the dimension in the up-down direction H1 of the bottom plate 85 may be small relative to the dimension in the up-down direction H2 of the process cartridge 14. For example, the dimension in the up-down direction H1 of the bottom plate 85 may be between 3% and 30% inclusive, preferably between 5% and 10% inclusive, of the dimension in the up-down direction H2 of the process cartridge 14. Therefore, the driving-force input members 130 and the electric-power supply members 132 may be surely disposed adjacent to the respective process cartridges 14.

Accordingly, an appropriate layout may be ensured.

(3) According to the above-described printer 1, as depicted in FIG. 2, the drawer 16 may be moved between the inside position and the outside position by which the left guide rail 185 and the right guide rail 185 guide the left thin-plate portion 93 and the right thin-plate portion 93, respectively, of the bottom plate 85.

Further, a driving force may be inputted to the driving-force receiving members 37 of the process cartridges 14 directly from the driving-force input members 130 and electric power may also be supplied to the electrode members 38 of the process cartridges 14 directly from the electric-power supply members 132 without using the drawer 16.

Accordingly, space saving may be achieved inside the casing 2, whereby reducing the printer 1 is size.

(4) According to the above-described printer 1, as depicted in FIG. 2, the driving-force input members 130 are disposed higher than the drawer 16. Therefore, a driving force may be easily inputted into the process cartridges 14 that are placed on the upper side of the drawer 16.

Accordingly, an appropriate layout may be ensured.

(5) According to the above-described printer 1, as depicted in FIG. 10, when the driving-force input members 130 are located at the disengaged position, the right end portion DE2 of the body portion 136 of each of the driving-force input members 130 is located between the left guide rail 185 and the right guide rail 185 in the right-left direction. Therefore, the interval between a driving-force input member 130 and a corresponding driving-force receiving member 37 in the right-left direction may be shortened.

Accordingly, the driving-force input members 130 may be reduced in size in the right-left direction, and thus, an increase in size the casing 2 in the right-left direction may be restricted.

(6) According to the above-described printer 1, as depicted in FIGS. 6 and 8, the driving-force input members 130 may be easily moved between the engaged position and the disengaged position by the left movable member 133.

As depicted in FIG. 2, the left movable member 133 is disposed such that the left movable member 133 overlaps the left end portion of the bottom plate 85 when projected in the up-down direction. Therefore, an increase in size of the casing 2 in the right-left direction may be restricted.

(7) According to the above-described printer 1, as depicted in FIG. 10, when the electric-power supply members 132 are located at the non-contacting position, the left end portion PE2 of the body portion 142 of each of the electric-power supply members 132 is located between the left guide rail 185 and the right guide rail 185 in the right-left direction. Therefore, the interval between an electric-power supply member 132 and a corresponding electrode member 38 may be shortened.

Accordingly, the electric-power supply members 132 may be reduced in size in the right-left direction, and thus, an increase in size of the casing 2 in the right-left direction may be restricted.

(8) According to the above-described printer 1, as depicted in FIGS. 6 and 8, the electric-power supply members 132 may be easily moved between the contacting position and the non-contacting position by the right movable member 133.

As depicted in FIG. 2, the right movable member 133 is disposed such that the right movable member 133 overlaps the right end portion of the bottom plate 85 when projected in the up-down direction. Therefore, an increase in size of the casing 2 in the right-left direction may be restricted.

(9) According to the above-described printer 1, as depicted in FIGS. 2 and 6, the left side plate 111 supports the driving-force input members 130 and the right side plate 111 supports the electric-power supply members 132. Therefore, the printer 1 may have a simple configuration.

The process cartridges 14 supported by the drawer 16 may be allowed to move in the space defined by the side plates 111.

Accordingly, further space saving may be achieved inside the casing 2.

(10) According to the above-described printer 1, as depicted in FIGS. 2 and 6, the power supply board 131 may be disposed between the right side plate 111 and the electric-power supply members 132 in the right-left direction. Therefore, an appropriate layout may be ensured.

(11) According to the above-described printer 1, as depicted in FIG. 4, the dimension in the up-down direction H1 of the bottom plate 85 is smaller than the dimension in the up-down direction H4 of the driving-force receiving member 37. Therefore, the drawer 16 may be further reduced in size.

(12) According to the above-described printer 1, as depicted in FIG. 4, the dimension in the up-down direction H3 of the recessed portion 88 may be 10% or less of the dimension in the up-down direction H2 of the process cartridges 14. Therefore, of the projected plane of the process cartridge 14 in the right-left direction when the drawer 16 supports the process cartridges 14, the dimension in the up-down direction of the area of the portion that overlaps the bottom plate 85 may be surely 10% or less of the total area of the projected plane of the process cartridge 14.

Accordingly, the drawer 16 may be reduced in size in the up-down direction.

(13) According to the above-described printer 1, as depicted in FIG. 1, the intermediate transfer belt 44 is disposed below the drawer 16 and across the drawer 16 from the process cartridges 14. A toner image may be transferred onto the intermediate transfer belt 44 disposed as described above

(14) According to the above-described printer 1, as depicted in FIGS. 1 and 3, the photosensitive drums 25 are exposed through the respective openings 91 of the bottom plate 85. Therefore, the photosensitive drums 25 and the intermediate transfer belt 44 may be easily come into contact with each other.

(15) According to the above-described printer 1, as depicted in FIGS. 1 and 3, the movement of the drawer 16 in the front-rear direction may be restricted by the simple configuration in which the stopper 90 is engaged with the engagement portion 186 of the casing 2.

(16) According to the above-described printer 1, as depicted in FIGS. 1 and 11, the process cartridges 14 are supported by the drawer 16 as a set.

Accordingly, all of the process cartridges 14 may be moved together between the inside and the outside of the casing 2.

9. Second Illustrative Embodiment

Figure 12:
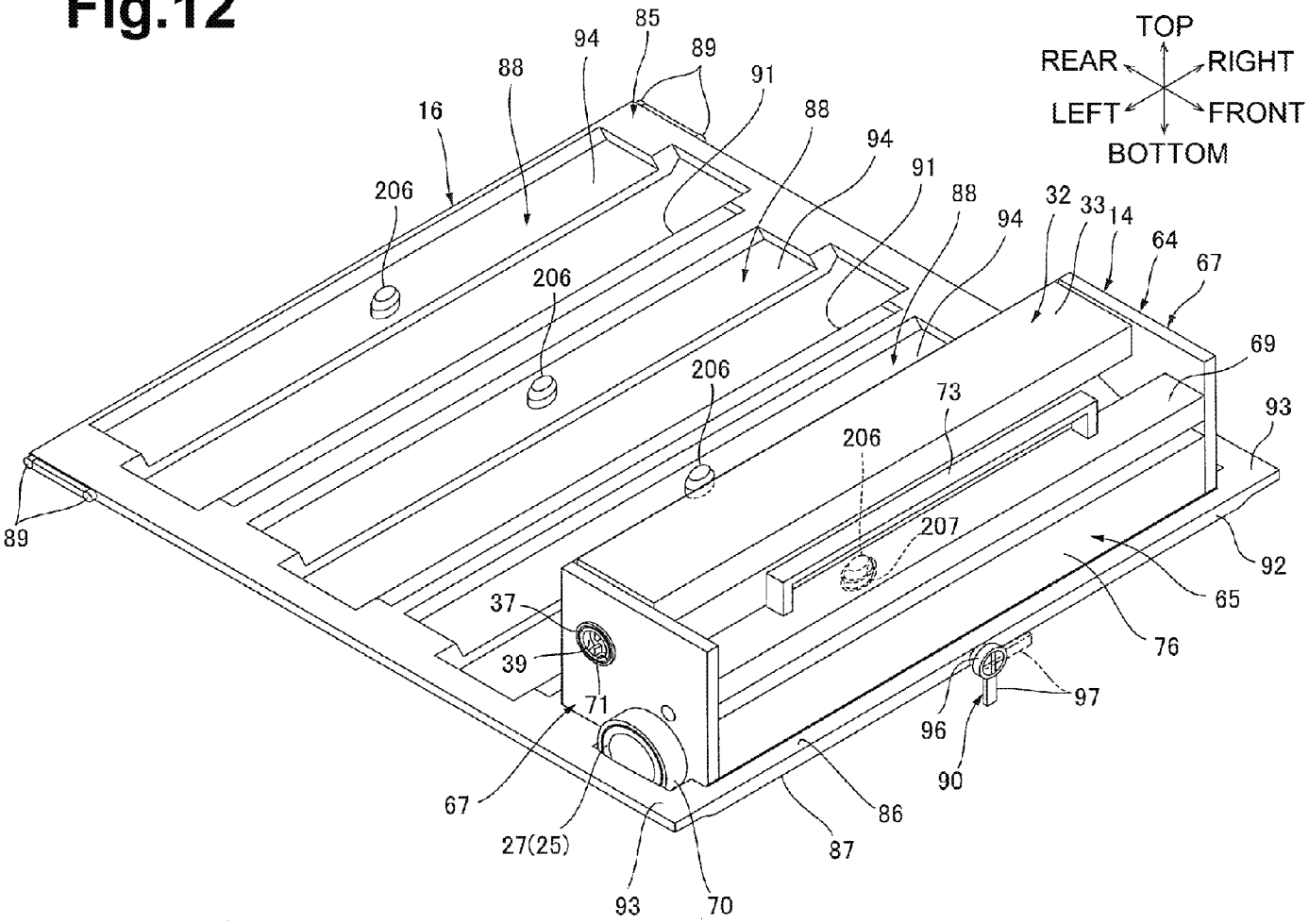
FIG. 12 is an upper front perspective view depicting a drawer of a printer in a second illustrative embodiment according to one or more aspects of the disclosure, wherein a frontmost support surface supports a process cartridge.

Referring to FIG. 12, a second illustrative embodiment will be described. An explanation will be given mainly for the parts different from the first illustrative embodiment, and an explanation will be omitted for the common parts by assigning the same or similar reference numerals thereto.

In the printer 1 of the first illustrative embodiment, as depicted in FIG. 3, a process cartridge 14 is supported only by a support surface 94 of a corresponding recessed portion 88.

In a printer 1 of the second illustrative embodiment, as depicted in FIG. 12, a process cartridge 14 is supported by a corresponding support surface 94 while the process cartridge 14 receives a corresponding protrusion 206 through an engagement hole 207 defined in the process cartridge 14.

More specifically, a bottom plate 85 further includes a plurality of, for example, four, protrusions 206 and process cartridges 14 each have an engagement hole 207. All of the protrusions 206 have the same or similar configuration and all of the engagement holes 207 have the same or similar configuration. Therefore, one of the protrusions 206 and one of the engagement holes 207 will be described in detail.

A protrusion 206 restricts movement of a corresponding process cartridge 14 in the front-rear direction relative to the drawer 16. The protrusion 206 is disposed at a substantially middle portion in the right-left direction of the recessed portion 88 in plan view and further to the rear than the opening 91. The protrusion 206 protrudes upward from a bottom surface (e.g., the support surface 94) of the recessed portion 88, and has a generally cylindrical column shape elongated in the right-left direction. An upper portion of the protrusion 206 is tapered toward the top such that a circumferential surface of the protrusion 206 is inclined toward its center in a diameter direction of the protrusion 206.

An engagement hole 207 is defined in a substantially middle portion of the bottom wall 68 of the cartridge frame 64 of the process cartridge 14 in side view and penetrates the bottom wall 68 in the up-down direction. The engagement hole 207 has a generally oval shape elongated in the right-left direction in bottom view.

The bottom plate 85 supports a process cartridge 14 by the support surface 94 of one of the recessed portions 88 while the process cartridge 14 receives the protrusion 206 through the engagement hole 207 thereof.

According to the printer 1 of the second illustrative embodiment, as depicted in FIG. 12, the engagement of the protrusion 206 with the engagement hole 207 of the process cartridge 14 may restrict the movement of the process cartridge 14 relative to the drawer 16.

Accordingly, even when the bottom plate 85 has a plate-like shape, the bottom plate 85 may support the process cartridges 14 with reliability. In particular, at the time of pulling the drawer 16 to the outside from the casing 2, falling of the process cartridges 14 that may be caused due to the force of a pull of the drawer 16 may be prevented or reduced.

According to the second illustrative embodiment, the effect that is the same as the effect obtained in the first illustrative embodiment may be obtained.

10. Third Illustrative Embodiment

Figure 13:
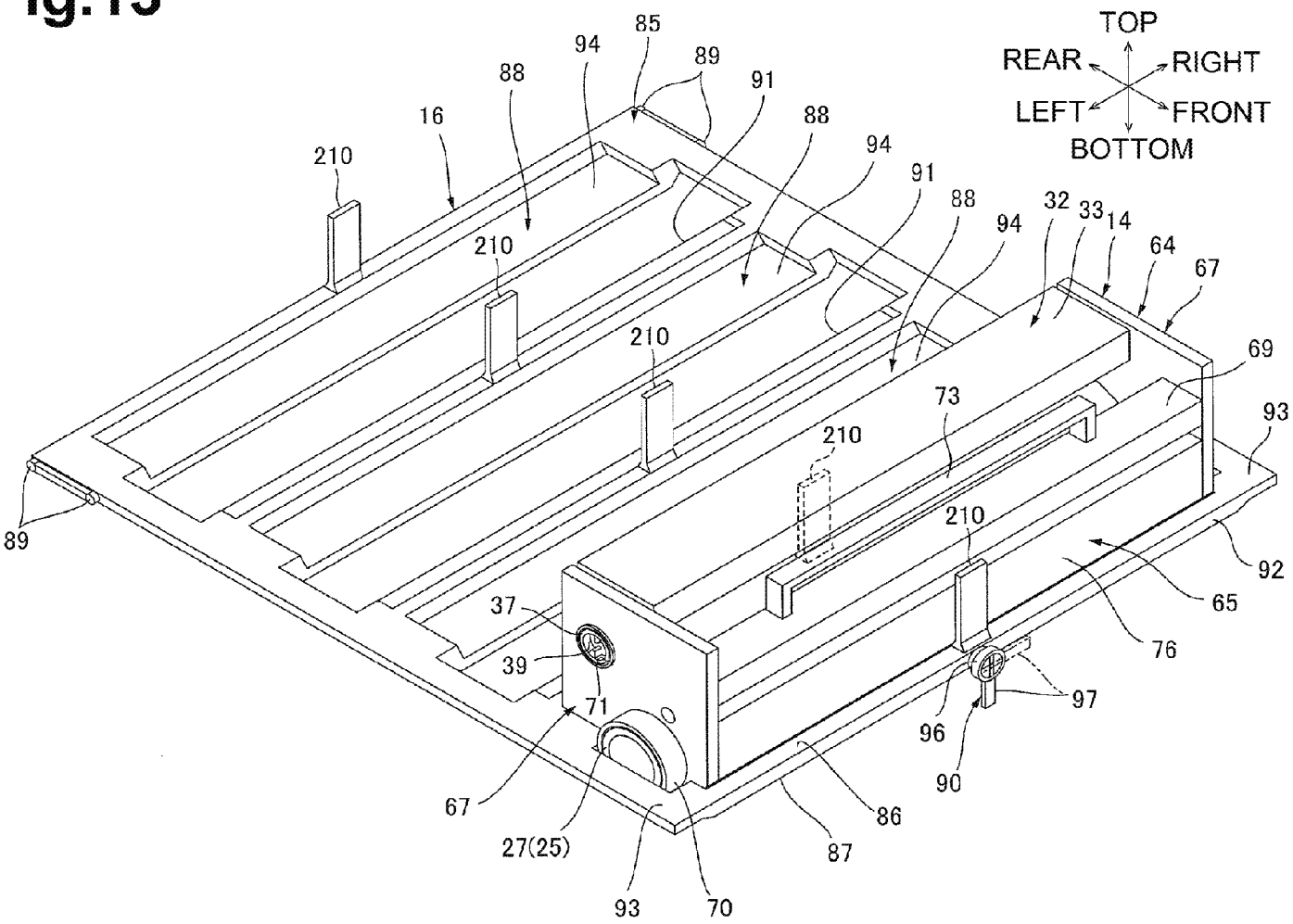
FIG. 13 is an upper front perspective view depicting a drawer of a printer in a third illustrative embodiment according to one or more aspects of the disclosure, wherein a frontmost support surface supports a process cartridge.

Referring to FIG. 13, a third illustrative embodiment will be described. An explanation will be given mainly for the parts different from the first illustrative embodiment, and an explanation will be omitted for the common parts by assigning the same or similar reference numerals thereto.

In the printer 1 of the first illustrative embodiment, as depicted in FIG. 3, a process cartridge 14 is supported only by a support surface 94 of a corresponding recessed portion 88.

In a printer 1 of the third illustrative embodiment, as depicted in FIG. 13, a bottom plate 85 further includes a plurality of, for example, five, restricting portions 210. All of the restricting portions 210 have the same or similar configuration, and therefore, one of the restricting portions 210 will be described in detail.

The restricting portion 210 regulates movement of a process cartridge 14 in the front-rear direction with respect to the drawer 16. One of the restricting portions 210 is disposed at a front end portion of the bottom plate 85, another of the restricting portions 210 is disposed at a rear end portion of the bottom plate 85, and the remainder of the restricting portions 210 are disposed at respective different portions of the bottom plate 85 between the recessed portions 88.

The restricting portion 210 protrudes upward from the upper surface 86 of the bottom plate 85. The restricting portion 210 has a generally rectangular plate shape in plan view and has a thickness in the front-rear direction. A dimension in the up-down direction of the restricting portion 210 is approximately half of the dimension in the up-down direction of the process cartridge 14.

A process cartridge 14 is supported by a support surface 94 of a corresponding recessed portion 88 while being sandwiched between corresponding two of the restricting portions 210 in the front-rear direction.

According to the printer 1 of the third illustrative embodiment, as depicted in FIG. 13, two of the restricting portions 210 sandwich a process cartridge 14 in the front-rear direction, whereby the movement of the process cartridge 14 with respect to the drawer 16 in the front-rear direction may be restricted.

Accordingly, even when the bottom plate 85 has a plate-like shape, the bottom plate 85 may support the process cartridges 14 with reliability. In particular, at the time of pulling the drawer 16 to the outside from the casing 2, falling of the process cartridges 14 that may be caused due to the force of a pull of the drawer 16 may be prevented or reduced.

According to the third illustrative embodiment, the effect that is the same as the effect obtained in the first illustrative embodiment may be obtained.

11. Fourth Illustrative Embodiment

Figure 14:
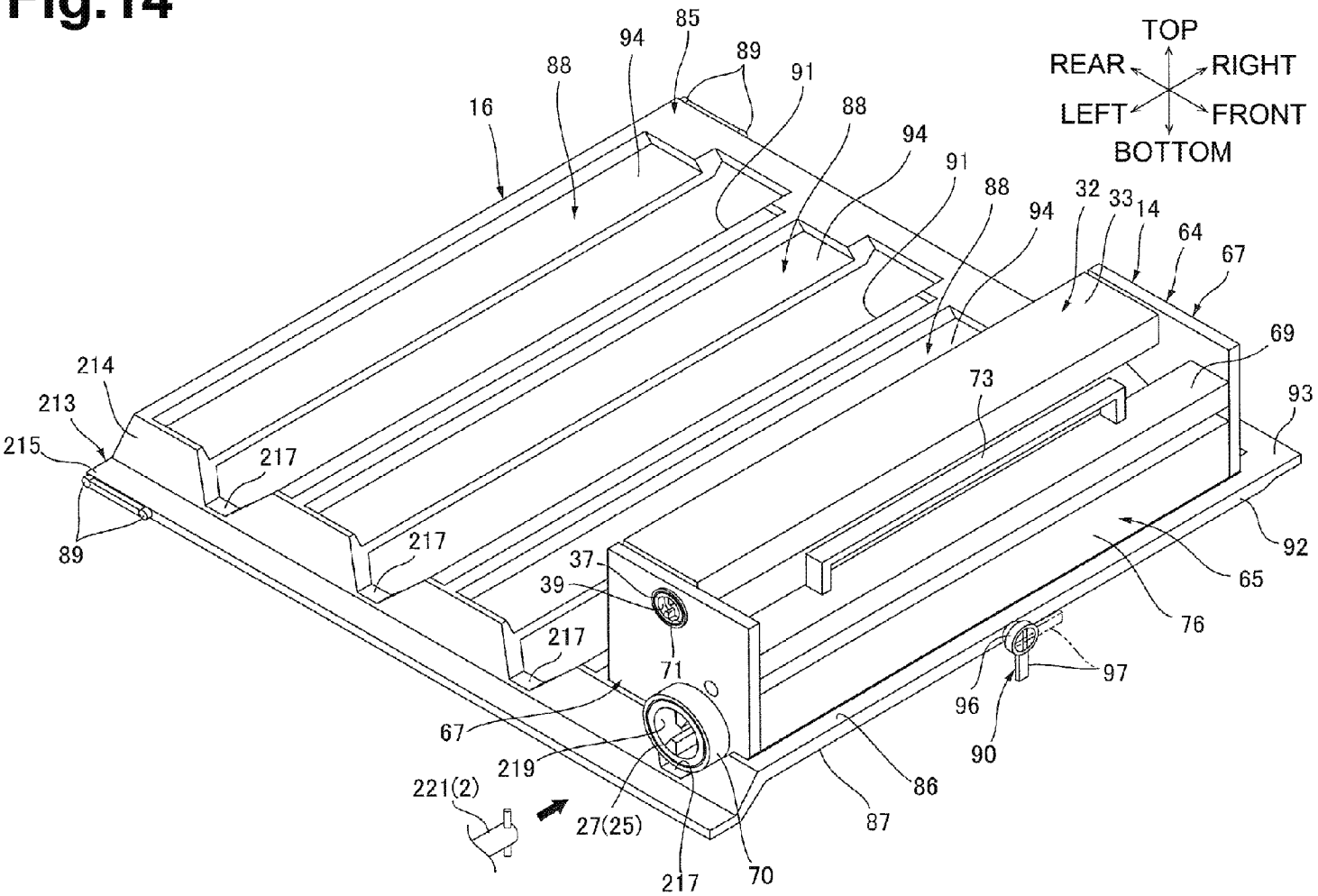
FIG. 14 is an upper front perspective view depicting a drawer of a printer in a fourth illustrative embodiment according to one or more aspects of the disclosure, wherein a frontmost support surface supports a process cartridge.

Referring to FIG. 14, a fourth illustrative embodiment will be described. An explanation will be given mainly for the parts different from the first illustrative embodiment, and an explanation will be omitted for the common parts by assigning the same or similar reference numerals thereto.

In the printer 1 of the first illustrative embodiment, as depicted in FIGS. 2 and 3, the process cartridges 14 are supported by the drawer 16 such that the lower end portions of the photosensitive drums 25 protrude downward relative to the bottom plate 85. Therefore, when projected in the right-left direction, the bottom plate 85 overlaps the photosensitive drums 25.

The drum gears 124 come into mesh with the gear teeth of the left flanges 27 of the photosensitive drums 25, respectively, whereby a driving force from the power source (not depicted) is transmitted to the photosensitive drums 25.

In a printer 1 of the fourth illustrative embodiment, as depicted in FIG. 14, a bottom plate 85 further includes a bent portion 213 at its left end portion.

The casing 2 further includes a plurality of, for example, four, driving-force input shafts 221, instead of the drum gears 124 of the first illustrative embodiment.

The bent portion 213 includes a first portion 214 and a second portion 215.

The first portion 214 has a generally plate shape extending in the front-rear direction. The first portion 214 extends downward and leftward from a left edge of the thick plate portion 92 of the bottom plate 85. The first portion 214 has a plurality of, for example, four, cutaway portions 217.

The cutaway portions 217 are spaced apart from each other in the front-rear direction while being arranged side by side in the front-rear direction. The cutaway portions 217 are recessed downward relative to an upper end of the first portion 214 and have a generally U shape in side view. Spacing between each cutaway portion 217 in the front-rear direction is the same as the spacing between each photosensitive drum 25 in the front-rear direction.

The second portion 215 has a generally plate shape extending in the front-rear direction. The second portion 215 extends leftward from a lower left end of the first portion 214. The rollers 89 are disposed at a rear end portion of a left end of the second portion 215.

The left flange 27 of each of the photosensitive drums 25 has not gear teeth on its peripheral surface but has a hole 219 defined therein.

The hole 219 is recessed rightward relative to a left surface of the left flange 27. The hole 219 has a generally circular shape in side view.

All of the driving-force input shafts 221 have the same or similar configuration, and therefore, one of the driving-force input shafts 221 will be described in detail. A driving-force input shaft 221 is disposed inside the casing 2 such that the driving-force input shaft 221 is disposed to the left of a hole 219 of a corresponding photosensitive drum 25. The driving-force input shaft 221 has a generally cylindrical column shape in the right-left direction. The driving-force input shaft 221 includes two engagement protrusions that protrude from a left end portion of the driving-force input shaft 221 in its diameter direction and have a generally cylindrical column shape. With this configuration, the driving-force input shaft 221 is configured to engage with the hole 219. The driving-force input shaft 221 is capable of moving in the right-left direction.

In a state where a process cartridge 14 is supported by the drawer 16, the flange support portion 70 of the photosensitive drum 25 of the process cartridge 14 is in engagement with one of the cutaway portions 217 and the hole 219 of the left flange 27 is exposed through the cutaway portion 217 when viewed from the left.

Then, the driving-force input shaft 221 moves rightward to come into engagement with the hole 219, whereby a driving force from the power source (not depicted) is transmitted to the photosensitive drum 25.

According to the fourth illustrative embodiment, a driving force may be inputted to the photosensitive drum 25 from the left of the process cartridge 14 while the drawer 16 may be reduced in size.

According to the fourth illustrative embodiment, the effect that is the same as the effect obtained in the first illustrative embodiment may be obtained.

12. Fifth Illustrative Embodiment

Figure 15:
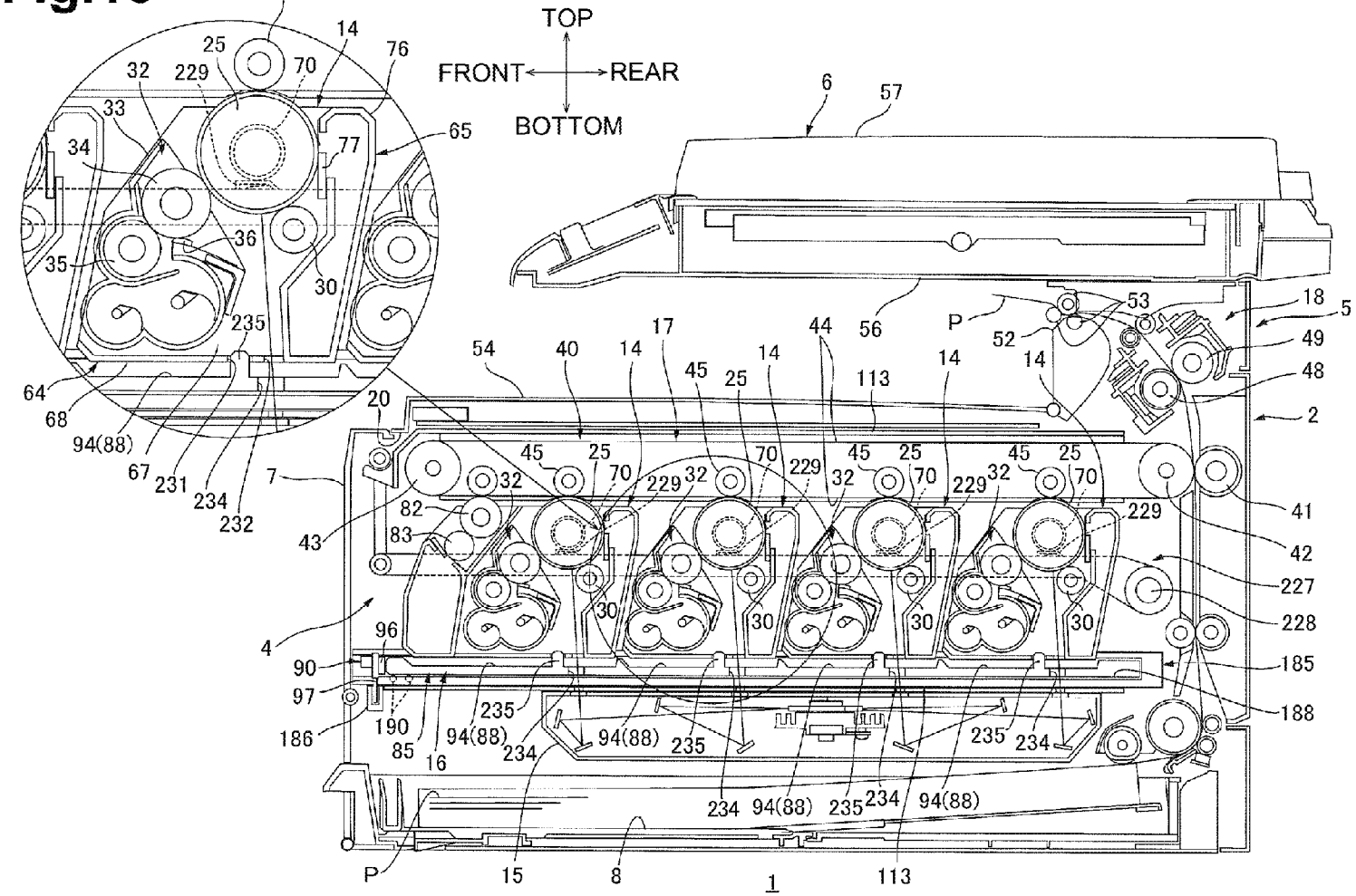
FIG. 15 is a central sectional view depicting a printer in a fifth illustrative embodiment according to one or more aspects of the disclosure.

Referring to FIG. 15, a fifth illustrative embodiment will be described. An explanation will be given mainly for the parts different from the first illustrative embodiment, and an explanation will be omitted for the common parts by assigning the same or similar reference numerals thereto.

In the printer 1 according to the first illustrative embodiment, as depicted in FIG. 1, the exposing device 15, the process cartridges 14, the drawer 16, the transfer unit 17 are arranged within the casing 2 in this order from above. Each of the process cartridges 14 includes the photosensitive drum 25 at its lower end portion.

In a printer 1 according to the fifth illustrative embodiment, as depicted in FIG. 15, a transfer unit 17, process cartridges 14, a drawer 16, an exposing device 15 are arranged within a casing 2 in this order from above. Each of the process cartridges 14 includes a photosensitive drum 25 at its upper end portion.

The casing 2 further includes right and left movable arms 227 for pressing the process cartridges 14 upward.

The right and left movable arms 227 are spaced apart from each other in the right-left direction so as to sandwich the process cartridges 14 therebetween in the right-left direction. Both of the movable arms 227 have the same or similar configuration, and therefore, one of the movable arms 227 will be described in detail. A movable arm 227 has a generally rectangular column shape extending in the front-rear direction. The movable arm 227 includes a rotating shaft 228 and a plurality of, for example, four, urging members 229.

The rotating shaft 228 has a generally cylindrical column shape. The rotating shaft 228 protrudes from a rear end portion of an outer surface of the movable arm 227 in the right-left direction toward the exterior of the printer 1. Another end of the rotating shaft 228 in the right-left direction are fixed to the frame 112.

The urging members 229 are disposed on an upper surface of the movable arm 227 while being spaced apart from each other in the front-rear direction. The urging members 229 protrude upward from the upper surface of the movable arm 227.

The process cartridges 14 each have an engagement hole 231 and a laser-beam passage hole 232 in the bottom wall 68.

The engagement hole 231 penetrates the bottom wall 68 in the up-down direction. The engagement hole 231 is defined in a substantially middle portion in the front-rear direction and in the right-left direction of the bottom wall 68. The engagement hole 231 has a generally rectangular shape in bottom view.

The laser-beam passage hole 232 penetrates the bottom wall 68 in the up-down direction. The laser-beam passage hole 232 is defined in a particular portion further to the rear than the engagement hole 231. The laser-beam passage hole 232 has a generally rectangular shape in bottom view and is elongated across the bottom wall 68 in the right-left direction.

Each recessed portion 88 of the bottom plate 85 further includes a laser-beam passage hole 234 and a restricting portion 235.

The laser-beam passage hole 234 is configured to allow a laser beam emitted from the exposing device 15 to pass therethrough. The laser-beam passage hole 234 penetrates the bottom plate 85 in the up-down direction at a rear end portion of the recessed portion 88. The laser-beam passage hole 234 has a generally rectangular shape in plan view and is elongated across the recessed portion 88 in the right-left direction.

The restricting portion 235 is configured to restrict movement of a process cartridge 14 in the front-rear direction relative to the drawer 16. The restricting portion 235 is disposed at a substantially middle portion of the recessed portion 88 in plan view and further to the front than the laser-beam passage hole 234. The restricting portion 235 has a generally rectangular column shape and protrudes upward from a bottom surface of the recessed portion 88.

The process cartridges 14 are placed above the respective recessed portions 88 of the bottom plate 85. More specifically, each of the process cartridges 14 is placed at a corresponding position while the process cartridge 14 receives the restricting portion 235 of the bottom plate 85 through the engagement hole 231 and the laser-beam passage hole 232 of the process cartridge 14 coincides with the laser-beam passage hole 234 of the bottom plate 85 in the up-down direction.

In a state where the right and left movable arms 227 extend frontward through their rotation on the rotating shaft 228, the urging members 229 are into contact with the lower end portions of the flange support portions 70 of the respective process cartridges 14 to press the process cartridges 14 upward.

Thus, the photosensitive drums 25 are positioned such that the photosensitive drums 25 are in contact with the outer surface of the lower portion of the intermediate transfer belt 44 of the transfer unit 17.

According to the printer 1 of the fifth illustrative embodiment, the exposing device 15 is disposed below the drawer 16 and the intermediate transfer belt 44 is disposed above the drawer 16. In such a printer 1, the exposing device 15 may expose the surfaces of the photosensitive drums 25 and a toner image may be transferred onto the intermediate transfer belt 44.

While the exposing device 15 is disposed across the drawer 16 from the process cartridges 14, the bottom plate 85 has the laser-beam passage holes 234. With this configuration, the laser-beam passage holes 234 allow laser beams emitted from the exposing device 15 to pass therethrough and thus the surfaces of the photosensitive drums 25 may be exposed with the laser beams reliably.

According to the fifth illustrative embodiment, the effect that is the same as the effect obtained in the first illustrative embodiment may be obtained.

What is claimed is:

1. An image forming apparatus comprising:
- a casing;
- a process cartridge including a photosensitive drum; and
- a drawer configured move between an inside position at which the drawer is located inside the casing and an outside position at which the drawer is located outside the casing in a sliding direction orthogonal to an axial direction of the photosensitive drum,
- the drawer including a bottom plate extending both in the axial direction and in the sliding direction,
- the bottom plate configured to support the process cartridge, the bottom plate having a flat surface on one side of the bottom plate and further having a recessed portion recessed relative to the flat surface toward the other side of the bottom plate in a height direction which is orthogonal to both the axial direction and the sliding direction,
- wherein the drawer has the flat surface at a portion of the one side that is closest to an upper exterior of the image forming apparatus in the height direction that the recessed portion, and
- wherein the recessed portion has a support surface configured to support the process cartridge.

2. The image forming apparatus according to claim 1, wherein a dimension in the height direction of the bottom plate is between 3% and 30% inclusive of a dimension in the height direction of the process cartridge.

3. The image forming apparatus according to claim 2, wherein a dimension in the height direction of the bottom plate is between 5% and 10% inclusive of a dimension in the height direction of the process cartridge.

4. The image forming apparatus according to claim 1, wherein the process cartridge further includes:
- a first end portion;
- a second end portion disposed opposite to the first end portion in the axial direction;
- a driving-force receiving member supported by the first end portion and configured to receive a driving force from the casing; and
- an electrode member supported by the second end portion and configured to receive electric power from the casing,
- wherein the bottom plate of the drawer further includes:
  - a first end portion; and
  - a second end portion disposed opposite to the first end portion in the axial direction,
- wherein the casing includes:
  - a first guide member configured to guide the first end portion of the bottom plate;
  - a second guide member configured to guide the second end portion of the bottom plate;
  - a driving-force input member configured to move between an engaged position at which the driving-force input member inputs a driving force to the driving-force receiving member in engagement with the driving-force receiving member and a disengaged position at which the driving-force input member is not in engagement with the driving-force receiving member; and
  - an electric-power supply member configured to move between a contacting position at which the electric-power supply member inputs electric power to the electrode member in contact with the electrode member and a non-contacting position at which the electric-power supply member is not in contact with the electrode member.

5. The image forming apparatus according to claim 4, wherein when the drawer is located at the inside position, the driving-force input member is located further to one side in the height direction than the drawer.

6. The image forming apparatus according to claim 4, wherein the driving-force input member includes:
- a first end portion disposed at a position farthest from the second guide member; and a second end portion disposed opposite to the first end portion in the axial direction and at a position nearest to the second guide member, wherein the second end portion of the driving-force input member is located between the first guide member and the second guide member when viewed in the height direction in a state where the driving-force input member is located at the disengaged position.

7. The image forming apparatus according to claim 4, further comprising a first movable member configured to move the driving-force input member between the engaged position and the disengaged position, and wherein the first movable member overlaps the bottom plate of the drawer when viewed in the height direction.

8. The image forming apparatus according to claim 4, wherein the electric-power supply member includes:

a first end portion disposed at a position farthest from the first guide member; and a second end portion disposed opposite to the first end portion in the axial direction and at a position nearest to the first guide member, wherein the second end portion of the electric-power supply member is located between the first guide member and the second guide member when viewed in the height direction in a state where the electric-power supply member is located at the non-contacting position.

9. The image forming apparatus according to claim 4, further comprising a second movable member configured to move the electric-power supply member between the contacting position and the non-contacting position, wherein the second movable member overlaps the drawer when viewed in the height direction.

10. The image forming apparatus according to claim 4, wherein the casing further includes:

a first side plate supporting the driving-force input member; and a second side plate disposed opposite to the first side plate in the axial direction while being spaced apart from the first side plate in the axial direction, the second side plate supporting the electric-power supply member, wherein the first guide member and the second guide member are disposed between the first side plate and the second side plate.

11. The image forming apparatus according to claim 10, wherein the casing further includes a power supply board for controlling electric power to be applied to the electric-power supply member, and wherein the power supply board is disposed between the second side plate and the electric-power supply member in the axial direction.

12. The image forming apparatus according to claim 4, wherein a dimension in the height direction of the drawer is smaller than a dimension in the height direction of the driving-force receiving member.

13. The image forming apparatus according to claim 1, wherein a dimension in the height direction of the recessed portion is 10% or less of the dimension in the height direction of the process cartridge.

14. The image forming apparatus according to claim 1, wherein the drawer further includes a restricting portion configured to restrict movement of the process cartridge in the sliding direction relative to the drawer.

15. The image forming apparatus according to claim 14, wherein the restricting portion includes a protrusion that extends from the support surface in a first direction of the height direction, and wherein the process cartridge further has an engagement hole configured to have the protrusion engaged therewith.

16. The image forming apparatus according to claim 14, wherein the restricting portion includes a plate-shaped member protruding from the flat surface in a first direction of the height direction.

17. The image forming apparatus according to claim 1, further comprising a transfer medium onto which a toner image is to be transferred, wherein the transfer medium is spaced apart from the drawer in a second direction of the height direction while disposed across the drawer from the process cartridge.

18. The image forming apparatus according to claim 17, wherein the drawer further has an opening configured to have the photosensitive drum exposed therethrough so as to face the transfer medium.

19. The image forming apparatus according to claim 1, further comprising a transfer medium onto which a toner image is to be transferred, wherein the transfer medium is spaced apart from the drawer in a first direction of the height direction while disposed across the drawer from the process cartridge, wherein the casing further includes an exposing device that is disposed across the drawer from the process cartridge and is configured to expose a surface of the photosensitive drum with a light beam.

20. The image forming apparatus according to claim 19, wherein the drawer further includes a light-beam passage portion configured to allow the light beam emitted from the exposing device to pass therethrough.

21. The image forming apparatus according to claim 1, wherein the drawer further includes a stopper configured to:

engage with an engagement portion of the casing; and restrict movement of the drawer in the sliding direction in engagement with the engagement portion of the casing.

22. The image forming apparatus according to claim 1, further comprising a plurality of process cartridges, wherein the process cartridges are arranged side by side along the sliding direction.

23. A drawer configured to support a process cartridge including a photosensitive drum and move between an inside position at which the drawer is located inside an image forming apparatus and an outside position at which the drawer is located outside the image forming apparatus in a sliding direction orthogonal to an axial direction of the photosensitive drum, the drawer comprising a bottom plate extending both in the axial direction and in the sliding direction, wherein the bottom plate is configured to support a process cartridge, wherein the bottom plate has a flat surface on one side of the bottom plate in a height direction orthogonal to both the axial direction and the sliding direction and a recessed portion recessed relative to the flat surface toward the other side of the bottom plate in the height direction, wherein the drawer has the flat surface at a portion of the one side that is closest to an upper exterior of the image forming apparatus in the height direction than the recessed portion, and wherein the recessed portion has a support surface configured to support the process cartridge.

24. An image forming apparatus comprising:

a casing;

a process cartridge including a photosensitive drum; and a drawer configured to move between an inside position at which the drawer is located inside the casing and an outside position at which the drawer is located outside the casing in a sliding direction orthogonal to an axial direction of the photosensitive drum, the drawer including a plate extending both in the axial direction and in the sliding direction and having a flat surface, the plate having a recessed portion recessed downward relative to the flat surface, the plate having an opening through which the photosensitive drum is exposed, wherein the recessed portion has a support surface extending in the axial direction and in the sliding direction that is configured to support the process cartridge, and wherein a portion of the plate juxtaposed to the opening in the axial direction is coplanar with a portion of the plate juxtaposed to the recessed portion in the axial direction.

25. The image forming apparatus according to claim 24, wherein the recessed portion is a first recessed portion and wherein the plate further comprises:

a second recessed portion wherein one side of the opening in the sliding direction is the first recessed portion and another side of the opening in the sliding direction is the second recessed portion, and wherein a length of the first recessed portion in the sliding direction is different from a length of the second recessed portion in the sliding direction.

26. The image forming apparatus according to claim 24, wherein the plate further comprises:

an additional surface that connects an upper surface of the recessed portion to an upper surface of the plate, wherein the additional surface is configured to minimize movement of the process cartridge in the axial and sliding directions.

27. An image forming apparatus comprising:

a casing;

at least two process cartridges, each of the process cartridges including a photosensitive drum; and a drawer configured to move between an inside position at which the drawer is located inside the casing and an outside position at which the drawer is located outside the casing in a sliding direction orthogonal to an axial direction of the photosensitive drum, the drawer including a plate extending both in the axial direction and in the sliding direction and having a flat surface, the plate having at least two recessed portions, each recessed portion recessed downward relative to the flat surface, wherein each recessed portion has a support surface extending in the axial direction and in the sliding direction that is configured to support one of the process cartridges, and wherein a non-recessed portion of the plate extends around the at least two process cartridges.

* * * * *